United States Patent [19]

Yoshioka et al.

[11] Patent Number: 4,585,478

[45] Date of Patent: Apr. 29, 1986

[54] HEAT RESISTING STEEL

[75] Inventors: Takatoshi Yoshioka; Seishin Kirihara; Masao Siga, all of Hitachi; Mitsuo Kuriyama, Ibaraki; Takehiko Yoshida; Takanori Murohoshi, both of Hitachi, all of Japan

[73] Assignee: Hitachi, Ltd., Tokyo, Japan

[21] Appl. No.: 607,288

[22] Filed: May 4, 1984

[30] Foreign Application Priority Data

May 6, 1983 [JP] Japan ..... 58-78182

[51] Int. Cl.[4] ..... C22C 38/06; C22C 38/28; C22C 38/50

[52] U.S. Cl. ..... 75/124; 75/126 D; 75/128 T; 75/126 P; 75/128 F; 75/126 C; 75/126 E; 75/128 W; 75/128 V

[58] Field of Search ..... 75/124 B, 126 D, 128 T, 75/126 P, 128 F, 124 R, 126 C, 126 E, 128 W, 128 V; 148/36

[56] References Cited

U.S. PATENT DOCUMENTS 3,403,060 9/1968 Ito et al. ..... 75/124
4,381,940 5/1983 Watanabe et al. ..... 75/128 T

FOREIGN PATENT DOCUMENTS 52-30716 3/1977 Japan ..... 75/124
54-26976 9/1979 Japan ..... 75/124

*Primary Examiner*—L. Dewayne Rutledge
*Assistant Examiner*—Deborah Yee
*Attorney, Agent, or Firm*—Antonelli, Terry & Wands

[57] ABSTRACT

A heat resisting steel suitable for use as the materials of steam turbine casings of steam turbines for thermal power generation. The steel has a composition consisting essentially of 0.05 to 0.2 wt % of C, 0.5 to 2.0 wt % of Cr, 0.5 to 2.0 wt % of Mo, 0.05 to 0.5 wt % of V, 0.002 to 0.1 wt % of Al, 0.0002 to 0.0030 wt % of B and the balance substantially Fe and inevitable impurities, wherein the sum of $\overline{X}$ and $\overline{Al}$ as obtained from the following formulae is not greater than 2920:

$$\overline{X}=10P+5Sb+4Sn+As$$

$$\overline{Al}=xAl$$

(x being a coefficient obtained from FIG. 4)

where, P,Sb,Sn and As represent the contents of P,Sb,Sn and As contained as said inevitable impurities in terms of ppm, while Al represents the Al content in terms of ppm. This heat resisting steel exhibits a large resistance to cracking in stress relief annealing after welding, as well as a high creep rupture strength at high temperature, and shows only a low crack developing speed.

25 Claims, 25 Drawing Figures

HEAT RESISTING STEEL

BACKGROUND OF THE INVENTION

The present invention relates to a novel heat resisting steel and, more particularly, to a heat resisting steel suitable for use as the material of turbine casing, main steam stop valve and steam regulating valve of steam turbine for large-scale thermal power generation.

Nowadays, the steam turbines for thermal power generation are required to operate at the maximum steam temperature and pressure of 538° C. and 246 atm. In order to withstand such a severe steam condition, the casing, etc. of the steam turbine are made of a Cr-Mo-V cast steel.

On the other hand, recently the improvement in the power generating efficiency in the power plant is becoming more significant, in view of the shortage of fossil fuels such as petroleum and coal, as well as the trend for saving of natural resources. Effective measures for attaining higher power generating efficiency are to raise the steam temperature or pressure and to increase the size of the steam turbine. When these measures are adopted, however, the conventional method used for turbine casing, etc., i.e. the Cr-Mo-V cast steel mentioned above, cannot provide a sufficient high-temperature strength. This gives rise to the demand for material having a greater high-temperature strength.

The present inventors made a study on a steel basically composed of Cr-Mo-V steel with addition of a very small amount of B, as a material which can safely be used when the steam turbine is large and the temperature and pressure of steam are increased. Although the addition of a very small amount of B improves the hardenability of the steel and provides a remarkable improvement in the high-temperature strength, it impairs the weldability and, in particular, undesirably increases the cracking sensitivity (SR cracking sensitivity), i.e. the sensitivity to cracking which occurs in a heat affected zone when the weld zone is subjected to a stress relief annealing after the welding. The material for the casing, steam regulating valve and main steam stop valve of steam turbine for thermal power generation has to have a high resistance to SR cracking, because these parts are integrated by welding and subjected to stress relief annealing after the welding.

Japanese Patent Application Laid-Open Publication No. 41962/80 discloses a Cr-Mo-B steel. This steel, however, does not contain V and, therefore, is low in high-temperature strength, particularly in creep rupture strength, and cannot be suitable for steam of high temperature of 593° C. In addition, in the above Publication nothing is disclosed at all about the weldability.

The specification of U.S. Pat. No. 3,316,084 discloses a Cr-Mo-V steel containing Al. This steel, however, does not contain B and, therefore, cannot provide a sufficiently high creep rupture strength.

SUMMARY OF THE INVENTION

Accordingly, an object of the invention is to provide a heat resisting steel having a high resistance to SR cracking after the welding and exhibiting a high high-temperature strength.

Another object of the invention is to provide a heat resisting steel having a small cracking developing speed.

To these ends, according to one aspect of the invention, there is provided a heat resisting steel having a composition consisting essentially of 0.05 to 0.2 wt% of C, 0.5 to 2.0 wt% of Cr, 0.5 to 2.0 wt% of Mo, 0.05 to 0.5 wt% of V, 0.002 to 0.1 wt% of Al, 0.0002 to 0.0030 wt% of B and the balance substantially Fe and inevitable impurities, wherein the sum of $\overline{X}$ and $\overline{Al}$ as obtained from the following formulae is not greater than 2920:

$$\overline{X}=10P+5Sb+4Sn+AS$$

$$\overline{Al}=xAl$$

(x being a coefficient obtained from FIG. 4)

where, P, Sb, Sn and As represent the contents of P, Sb, Sn and As contained as said inevitable impurities in terms of ppm, while Al represents the Al content in terms of ppm.

According to one form of the invention, the heat resisting steel further contains not greater than 1 wt% of Si, not greater than 2 wt% of Mn, not greater than 0.5 wt% of Ni and not greater than 0.2 wt% of Ti, and has a 600° C. $10^5$ hr creep rupture strength of not smaller than 9 Kg/mm$^2$, room temperature elongation of not smaller than 15% and a room temperature tensile reduction of area of not smaller than 50%.

Preferably, the heat resisting steel of the invention has a composition consisting essentially of 0.08 to 0.15 wt% of C, 0.9 to 1.7 wt% of Cr, 0.8 to 1.3 wt% of Mo, 0.1 to 0.35 wt% of V, 0.15 to 0.75 wt% of Si, 0.2 to 0.6 wt% of Mn, 0.1 to 0.3 wt% of Ni, 0.005 to 0.07 wt% of Al, 0.045 to 0.15 wt% of Ti, 0.0005 to 0.0020 wt% of B and the balance substantially Fe, and has a whole tempered bainite structure.

The steel of the invention may be either cast or forged, although the advantages of the invention are remarkable particularly when the steel is used for cast products.

The steel of the invention further contains not greater than 0.2 wt% in total of at least one selected from the group consisting of not greater than 0.1 wt% of Ca, not greater than 0.1 wt% of Mg, not greater than 0.2 wt% of Zr, not greater than 0.2 wt% of Nb and not greater than 0.2 wt% of W.

According to another aspect of the invention, there is provided a heat resisting steel having a composition consisting essentially of 0.05 to 0.2 wt% of C, 0.5 to 2.0 wt% of Cr, 0.5 to 2.0 wt% of Mo, 0.05 to 0.5 wt% of V, not greater than 1 wt% of Si, 0.002 to 0.1 wt% of Al, and the balance substantially Fe and inevitable impurities, wherein the sum of $\overline{X}$ and $\overline{Al}$ as obtained from the following formulae is not greater than 2920, and wherein the sum of $\overline{X}$ and $\overline{Si}$ as obtained from the following formulae is not greater than 3200:

$$\overline{X}=10P+5Sb+4Sn+As$$

$$\overline{Al}=xAl$$

(x being a coefficient obtained from FIG. 4)

$$\overline{Si}=Si/y$$

(y being a coefficient obtained from FIG. 17)

where, P, Sb, Sn and As represent the contents of P, Sb, Sn and As contained as said inevitable impurities in terms of ppm, while Al and Si represent the Al and Si contents in terms of ppm.

As in the case of the steel of the first aspect, the steel of the second aspect of the invention further contains Mn, Ni and Ti, and can contain at least one of Ca, Mg, Zr, Nb and W. This steel has same preferred ranges in contents of C, Cr, Mo, V, Mn, Ni, Al and Ti as mentioned before and preferably has an Si content not greater than 0.15 wt% so that the contents of impurities are made larger.

The steel of the invention can suitably be used for the casing of the steam turbines for thermal power generation. Usually, the steam turbine casing is composed of major parts including a casing body, a main steam stop valve and a steam regulating valve. The heat resisting steel of the invention can be applied to at least one of such major parts of the steam turbine casing. The steel of the invention is suitable for use as the material of a steam turbine casing which is used at steam temperatures of 538° C., 593° C. and 650° C. at steam pressure of 316 atm. The casing body is formed by casting, while the main steam stop valve and the steam regulating valve are formed either by casting or forging. Preferably, the casing is subjected to a tempering after a hardening or normalizing to have whole tempered bainite structure. The casing made of the steel of the invention has a crack developing speed of not greater than $20\times10^{-3}$ (mm/h) at 550° C.

The reasons for numerical limitations on the content ranges of respective components are as follows.

C is an element which is essential for increasing the high-temperature strength. For obtaining a satisfactory result, the C content has to be not smaller than 0.05 wt%. On the other hand, when the C content exceeds 0.25 wt%, an embrittlement of the steel occurs due to excessive precipitation of carbides, etc. to decrease the creep rupture strength particularly at the long-time side and to increase the cracking sensitivity of the weld zone. For these reasons, the C content is selected to be not greater than 0.25 wt%. When specifically high strength and toughness are required, the C content is preferably selected to range between 0.05 and 0.20 wt%, more preferably between 0.08 and 0.15 wt%.

Si and Mn are generally added as deoxidizers. These elements, therefore, need not be added if other suitable deoxidation means, e.g. carbon deoxidation under reduced pressure, is adopted. As a matter of fact, however, these elements are contained as impurities. The contents of such impurities are usually not greater than 0.1 wt%. When the above-mentioned specific deoxidation means is not adopted, Si and Mn as deoxidizers are contained by amounts of not greater than 1 wt% and not greater than 2 wt%, respectively. The Si content is preferably less than 0.75 wt% and more preferably between 0.5 and 0.75 wt%, while Mn content preferably ranges between 0.2 and 0.6 wt%. These elements are effective in improving the hardenability but undesirably increase the sensitivity to temper brittleness when the above-mentioned ranges in their contents are exceeded. In addition, the Si content is preferably selected to be not greater than 0.35 wt%, because an Si content exceeding 0.35 wt% increases the crack developing speed disadvantegeously.

Ni is an element which is effective in increasing the toughness and can be contained by an amount not greater than 0.5 wt%. Any Ni content in excess of 0.5 wt% decreases the creep rupture strength. For obtaining a high strength and toughness, the Ni content preferably ranges between 0.1 and 0.5 wt% and more preferably between 0.1 and 0.3 wt%.

Cr is a carbide former and is an essential element for the material used at high temperature because it increases the high-temperature strength and enhances the oxidation resistance. For obtaining appreciable effect of addition of Cr, the Cr content should be at least 0.5 wt%. On the other hand, any Cr content exceeding 2.0 wt% allows a coarsening of precipitates by a long heating at high temperature, resulting in a lowered creep rupture strength, the Cr content preferably ranges between 0.9 and 1.7 wt%.

Mo is an element which enhances the creep rupture strength through solid solution strengthening and precipitation hardening, and further prevents the temper brittleness. In order to obtain appreciable effect of increase in the creep rupture strength, the Mo content should be not smaller than 0.5 wt%. The effect, however, is saturated when the Mo content exceeds 2 wt%. For obtaining a specifically high creep rupture strength, the Mo content is selected to range preferably between 0.8 and 1.3 wt%.

V is an element which increases the creep rupture strength through formation of carbides upon reaction with C. A V content not greater than 0.05 wt%, however, cannot provide sufficient increase in the strength. V content exceeding 0.5 wt% should be avoided because it undesirably increases the cracking sensitivity in the stress relief annealing after the welding. For obtaining specifically high creep rupture strength and ductility, the V content preferably ranges between 0.10 and 0.35 wt% and more preferably between 0.2 and 0.35 wt%.

B is an element which improves the hardenability and remarkably increases the creep rupture strength. A B content not greater than 0.0003 wt%, however, cannot provide sufficient increase in the high-temperature strength. On the other hand, any B content exceeding 0.0030 wt% should be avoided because it seriously increases the cracking sensitivity in the stress relief annealing after the welding. In order to obtain a specifically high creep rupture strength and low cracking sensitivity in the stress relief annealing, the B content is preferably selected to range between 0.0005 and 0.0020 wt%.

Al is an element which fixes N in the steel to prevent reaction between B and N thereby to maximize the strengthening effect produced by B. However, any Al content not greater than 0.002 wt% cannot produce sufficient high-temperature strength. Al content exceeding 0.1 wt% should be avoided also because such a high Al content drastically lowers the high-temperature strength. In order to lower the cracking sensitivity in the stress relief annealing while attaining a high-temperature strength, the Al content preferably ranges between 0.005 and 0.07 wt%. For obtaining a remarkable reduction in the cracking sensitivity in the stress relief annealing regardless of the contents of impurities in the steel while attaining a high strength, the Al content preferably ranges between 0.05 and 0.020 wt%.

Ti is an element which fixes N as in the case of Al to enhance the strengthening effect produced by B. To this end, Ti is contained by an amount not greater than 0.2 wt% because the effect of addition of Ti is saturated when the Ti content exceeds 0.2 wt%. For obtaining a specifically high strength, the Ti content ranges preferably between 0.045 and 0.15 wt% and more preferably between 0.05 and 0.12 wt%.

For attaining high strength at high temperature, it is preferred to add Al and Ti in combination. In such a case, the sum of Al content and Ti content preferably ranges between 0.06 and 0.15 wt% and more preferably between 0.07 and 0.13 wt%.

Correlation Between $\overline{X}$ and $\overline{Al}$

Impurities such as P, Sb, Sn and As which are inevitably contained in the steel making process are segragated in the grain boundaries when the steel is heated to a high temperature, thereby embrittling the grain boundaries. If the contents of these impurities are large, the cracking sensitivity in the stress relief annealing after welding (SR cracking sensitivity) is increased drastically. A further increase in the contents of these impurities causes a temperature brittleness of the steel, as well as embrittlement during the use of the steel. Since these elements seriously affect the SR cracking sensitivity in the steels containing B, it is necessary to control the value $\overline{X}$ which is given by the following formula. Further, since the SR cracking sensitivity is increased also by Al, the contents of the aforesaid impurity elements should be controlled by a correlation between $\overline{X}$ and $\overline{Al}$.

$$\overline{X}=10P+5Sb+4Sn+As$$

In this formula, the contents of the impurity elements are expressed in terms of ppm.

$\overline{X}$ and $\overline{Al}$ are expressed respectively in terms of ppm, and the sum of $\overline{X}$ and $\overline{Al}$ should be not greater than 2920. Since the $\overline{Al}$ provides different degrees of effect on the SR cracking sensitivity, the $\overline{Al}$ is expressed by xAl, where x represents a coefficient the value of which varies depending on the Al content. For instance, when the Al content is not greater than 0.015 wt%, the value of the coefficient x is zero. This means that the Al content not greater than 0.015 wt% does not materially affect the SR cracking sensitivity. The coefficient x takes values of 4.4 at Al content of 0.016 wt%, 4.0 at 0.02 wt%, 3.5 at 0.025 wt%, 3.1 at 0.03 wt%, 2.7 at 0.04 wt%, 2.4 at 0.05 wt%, 2.1 at 0.06 wt%, 1.8 at 0.07 wt%, 1.55 at 0.08 wt%, 1.3 at 0.09 wt% and 1.0 at 0.1 wt%.

When the Al content is not greater than 0.015 wt%, the $\overline{X}$ takes a value of not greater than 2920.

By maintaining the value $\overline{X}$ below the value mentioned above, it is possible to keep the SR cracking ratio below 20% and, hence, to prevent SR cracking in multilayer welding. The SR cracking ratio can be maintained below 20% by maintaining the value $\overline{X}$ below 2210 at Al content of 0.016 wt%, below 2130 at 0.02 wt%, below 1990 at 0.03 wt%, below 1840 at 0.04 wt%, below 1720 at 0.05 wt%, below 1660 at 0.06 wt%, below 1640 at 0.07 wt%, below 1680 at 0.08 wt%, below 1770 at 0.09 wt% and below 1920 at 0.10 wt%.

Correlation between Al and Ti

As stated below, Al and Ti impose similar effects on the strengthening of the steel, so that there is a definite correlation between the Al and Ti contents.

Namely, the high-temperature strength is affected by the sum of Al and Ti contents. More specifically, a high strength at high temperature is obtained when the sum ranges between 0.06 and 0.15 wt% and a greater effect is obtained when the same ranges between 0.07 and 0.13 wt%.

The high-temperature strength is affected also by the ratio Ti/Al. A high creep rupture strength is obtained when the ratio takes a value ranging between 0.8 and 14 and a higher effect is obtained when the same ranges between 0.9 and 9.5.

The ratio Al/Ti also is a factor which affects the high-temperature strength. This ratio preferably takes a value ranging between 0.07 and 1.25 and more preferably between 0.105 and 1.15.

Correlation Between $\overline{X}$ and $\overline{Si}$

Si content and the value $\overline{X}$ are factors which increases the crack developing speed. In order to decrease the crack developing speed, therefore, it is necessary to lower the Si content and the contents of P, Sb, Sn and As in terms of the value $\overline{X}$ which is calculated in accordance with the aforementioned formula. To this end, the sum of the value $\overline{X}$ and a value $\overline{Si}$ which is given by the following formula should be maintained to be not greater than 3200.

$$\overline{Si}=Si/Y$$

where, Si represents the Si content in terms of ppm, while y represents a coefficient which is obtained from FIG. 17.

By maintaining the sum of values $\overline{X}$ and $\overline{Si}$ below 3200, it is possible to maintain the crack developing speed below $20\times10^{-3}$ mm/h. Crack developing speed can be further decreased down below $10\times10^{-3}$ mm/h, below $5\times10^{-3}$ mm/h and below $2.5\times10^{-3}$ mm/h, respectively by maintaining the above-mentioned total value below 2900, below 2700 and below 2600.

Other Elements

Zr and Nb are elements which react with N to prevent the formation of nitrides of B thereby to increase the creep rupture strength, as in the cases of Al and Ti.

Zr is effective also in fixing S to prevent segregation of S in the grain boundaries in the heat affected zone of weld zone. The addition of Zr, therefore, is effective also in preventing the SR cracking attributable to the segregation of impurities such as S in the grain boundaries. An appreciable effect of addition of Zr is obtained when the Zr content is below 0.2 wt%. A Zr content exceeding 0.2 wt% undesirably decreases the toughness. The Zr content, therefore, should be maintained below 0.2 wt%.

Ca is a strong deoxidizer. In addition, Ca fixes S in the steel upon reaction therewith as is the case of Zr, thereby to suppress the segregation of S to the grain boundaries. The addition of Ca, therefore, is effective also in the prevention of SR cracking. A Ca content exceeding 0.1 wt%, however, decreases the high-temperature strength undesirably. In order to enjoy the effect of reduction in the SR cracking sensitivity, therefore, the Ca content is selected preferably to range between 0.002 and 0.1 wt %.

W is a carbide former and is effective in increasing the high-temperature strength when its content is not greater than 0.2 wt%. An increase in W content beyond 0.2 wt% undesirably lowers the ductility at high temperature. The W content, therefore, is selected preferably not to exceed 0.1 wt%.

Heat Treatment

The steel of the invention is applicable to both of forged steel and cast steel. The advantages of the steel of the invention are remarkable particularly when the steel is a cast steel used under a condition wherein the impurity elements exist as-segregated state.

The steel of the invention is subjected as a heat treatment to at least hardening or normalizing and tempering. The hardening or normalizing is conducted preferably by holding the steel at temperature of 9000° to 1100° C. for more than 2 hours and then cooling the same forcibly. The tempering is conducted preferably by holding the steel at a temperature of 680° to 730° C. for more than 2 hours and then cooling the same slowly. An appreciable increase in toughness is obtained by repeating the tempering twice or more. It is also preferred to repeat the process including the hardening and tempering twice.

Preferably, the steel of the invention has a whole tempered bainite structure. With this structure, the steel of the invention can exhibit a high strength at high temperature. The hardness of the steel of the invention preferably has a Brinell hardness ($H_B$) ranging between 170 and 260. The steel of the invention having such hardness exhibits a high strength at high temperature, as well as a low SR cracking sensitivity.

Welding

When a joint is formed by welding members made of the steel of the invention or when a member made of the steel of the invention is repaired by welding, the welding is preferably conducted after preheating up to 250° C. or higher temperature, and the stress relief (SR) treatment is commenced preferably when the temperature is still 150° C. or higher in the course of the cooling after the welding. The notch toughness in the heat affected zone of weld zone is improved and the residual stress in the weld zone is lowered by repeating the SR treatment.

The welding is conducted preferably with a welding rod of Cr-Mo system. When hardening and tempering are to be conducted after the welding, the welding rod is preferably of Cr-Mo-V system, in view of the creep rupture strength. The welding can be carried out by various welding methods including shielded metal arc welding, semi-automatic MIG welding, semi-automatic composite wire welding and submerged arc welding.

The invention will become more clear from the following description of the Examples when the same is read with reference to the accompanying drawings.

DESCRIPTION OF EXAMPLES

EXAMPLE 1

Figure 1:
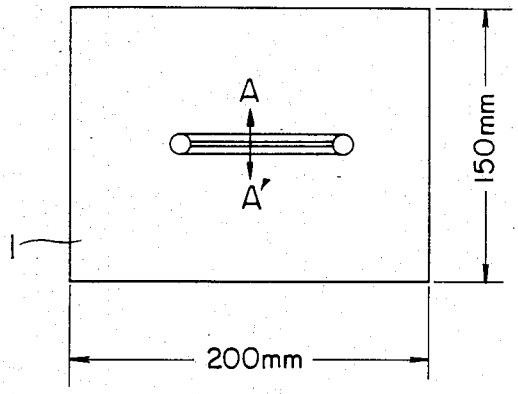
FIG. 1 is a plan view of a test piece used in a test conducted for confirming the cracking sensitivity in the stress relief annealing after welding.

A steel in accordance with the invention was molten by a high-frequency induction melting furnace and was poured into sand molds to become ingots of 130 mm thick, 400 mm long and 400 mm wide. The samples were subjected to a heat treatment consisting of a normalizing in which the steel was held at 1,050° C. for 15 hours and then cooled at a rate of 400° C./h, and a subsequent tempering in which the steel was held at 730° C. for 15 hours followed by a furnace cooling.

Table 1 shows the chemical compositions of test materials used in the test. The compositions are expressed in terms of weight percents. All test materials had uniform whole tempered bainite structure.

The sample No. 1 is a steel containing 0.0003 wt% of B which is the lower limit of the B content in the steel of the invention, while contents of other elements fall within the ranges of those of Cr-Mo-V cast steel conventionally used as the material of the steam turbine casing.

Samples Nos. 2 to 9 are for examining the influences of Al and Ti, while samples Nos. 10 to 12 are for examining the influences of impurities such as P, Sb, Sn and As. Samples Nos. 13 to 15 are for examining the influence of Si content, while Samples Nos. 16 and 17 are for examing the effects of addition of Zr and Ca, respectively. Samples Nos. 3 and 10 are comparison materials, while samples Nos. 1, 2, 4 to 9 and 11 to 17 are the steels in accordance with the invention.

TABLE 1

| | No. | C | Si | Mn | P | S | Cu | Ni | Cr | Mo | V | Al | Ti | B | Sb | Sn | As |
|---|---|---|---|---|---|---|---|---|---|---|---|---|---|---|---|---|---|
| Steels of invention | 1 | 0.11 | 0.44 | 0.43 | 0.014 | 0.007 | 0.07 | 0.26 | 1.50 | 1.10 | 0.27 | 0.008 | 0.0023 | 0.0003 | 0.0021 | 0.013 | 0.011 |
| Steels of invention | 2 | 0.14 | 0.52 | 0.48 | 0.014 | 0.007 | 0.07 | 0.20 | 1.42 | 1.14 | 0.24 | 0.018 | 0.071 | 0.0009 | 0.0014 | 0.008 | 0.009 |
| Comparison steel | 3 | 0.11 | 0.43 | 0.50 | 0.014 | 0.005 | 0.06 | 0.16 | 1.48 | 1.15 | 0.21 | 0.083 | 0.060 | 0.0010 | 0.0013 | 0.008 | 0.009 |
| Steels of invention | 4 | 0.12 | 0.50 | 0.50 | 0.014 | 0.005 | 0.06 | 0.16 | 1.36 | 1.14 | 0.21 | 0.037 | 0.059 | 0.0008 | 0.0014 | 0.008 | 0.008 |
| Steels of invention | 5 | 0.14 | 0.37 | 0.38 | 0.014 | 0.0010 | 0.15 | 0.28 | 1.40 | 1.14 | 0.23 | 0.025 | 0.068 | 0.0008 | 0.0013 | 0.007 | 0.009 |
| Steels of invention | 6 | 0.11 | 0.45 | 0.33 | 0.014 | 0.007 | 0.09 | 0.25 | 1.38 | 1.16 | 0.21 | 0.014 | 0.059 | 0.0009 | 0.0012 | 0.008 | 0.010 |
| Steels of invention | 7 | 0.12 | 0.45 | 0.46 | 0.012 | 0.006 | 0.07 | 0.18 | 1.42 | 1.13 | 0.21 | 0.013 | 0.025 | 0.0011 | 0.0011 | 0.009 | 0.011 |
| Steels of invention | 8 | 0.12 | 0.44 | 0.45 | 0.011 | 0.008 | 0.05 | 0.18 | 1.42 | 1.13 | 0.24 | 0.013 | 0.095 | 0.0008 | 0.0011 | 0.008 | 0.008 |
| Steels of invention | 9 | 0.13 | 0.44 | 0.46 | 0.011 | 0.006 | 0.07 | 0.16 | 1.45 | 1.15 | 0.21 | 0.014 | 0.110 | 0.0009 | 0.0011 | 0.008 | 0.008 |
| Comparison steel | 10 | 0.13 | 0.43 | 0.45 | 0.025 | 0.005 | 0.07 | 0.21 | 1.42 | 1.13 | 0.23 | 0.013 | 0.095 | 0.0011 | 0.0018 | 0.013 | 0.011 |
| Steels of invention | 11 | 0.14 | 0.42 | 0.44 | 0.018 | 0.008 | 0.08 | 0.18 | 1.43 | 1.13 | 0.22 | 0.012 | 0.095 | 0.0010 | 0.0015 | 0.014 | 0.011 |
| Steels of invention | 12 | 0.13 | 0.41 | 0.46 | 0.016 | 0.007 | 0.08 | 0.18 | 1.50 | 1.16 | 0.24 | 0.014 | 0.090 | 0.0010 | 0.0015 | 0.013 | 0.009 |
| Steels of invention | 13 | 0.11 | 0.26 | 0.42 | 0.014 | 0.007 | 0.06 | 0.22 | 1.43 | 1.14 | 0.24 | 0.014 | 0.115 | 0.0009 | 0.0013 | 0.005 | 0.007 |
| Steels of invention | 14 | 0.12 | 0.10 | 0.50 | 0.013 | 0.005 | 0.06 | 0.17 | 1.42 | 1.15 | 0.25 | 0.013 | 0.112 | 0.0008 | 0.0012 | 0.007 | 0.008 |
| Steels of invention | 15 | 0.12 | 0.06 | 0.41 | 0.015 | 0.007 | 0.05 | 0.16 | 1.42 | 1.13 | 0.23 | 0.012 | 0.110 | 0.0008 | 0.0011 | 0.006 | 0.007 |
| Steels of invention | 16 | 0.11 | 0.25 | 0.42 | 0.013 | 0.006 | 0.04 | 0.20 | 1.45 | 1.14 | 0.22 | 0.013 | 0.105 | 0.0009 | 0.0012 | 0.006 | 0.009 |
| Steels of invention | 17 | 0.13 | 0.25 | 0.42 | 0.013 | 0.006 | 0.04 | 0.19 | 1.45 | 1.13 | 0.23 | 0.012 | 0.115 | 0.0009 | 0.0013 | 0.006 | 0.009 |

| | No. | Others | Ti/Al | Al + Ti | Al/Ti |
|---|---|---|---|---|---|
| Steels of invention | 1 | — | 0.29 | 0.0103 | 3.48 |
| Steels of invention | 2 | — | 3.94 | 0.089 | 0.25 |
| Comparison steel | 3 | — | 0.72 | 0.143 | 1.38 |
| Steels of invention | 4 | — | 1.59 | 0.096 | 0.63 |
| Steels of invention | 5 | — | 2.72 | 0.093 | 0.37 |
| Steels of invention | 6 | — | 4.21 | 0.073 | 0.24 |
| Steels of invention | 7 | — | 1.92 | 0.038 | 0.52 |
| Steels of invention | 8 | — | 7.31 | 0.108 | 0.14 |
| Steels of invention | 9 | — | 7.86 | 0.124 | 0.13 |
| Comparison steel | 10 | — | 7.31 | 0.108 | 0.14 |
| Steels of invention | 11 | — | 7.92 | 0.107 | 0.13 |
| Steels of invention | 12 | — | 6.43 | 0.104 | 0.16 |
| Steels of invention | 13 | — | 8.21 | 0.129 | 0.12 |
| Steels of invention | 14 | — | 8.62 | 0.125 | 0.12 |
| Steels of invention | 15 | — | 9.17 | 0.122 | 0.11 |
| Steels of invention | 16 | Zr 0.013 | 8.08 | 0.118 | 0.12 |
| Steels of invention | 17 | Ca 0.002 | 9.58 | 0.127 | 0.10 |

An SR cracking test was conducted in accordance with the testing method as specified in JIS Z 3158, using a Y-shaped weld crack test piece (30 mm thick) as shown in FIG. 1. A one-path welding of about 5 mm thick was conducted under the welding condition as shown in Table 3, using a commercially available coated electrode (diameter 4 mm) for Cr-Mo steels.

Figure 2:
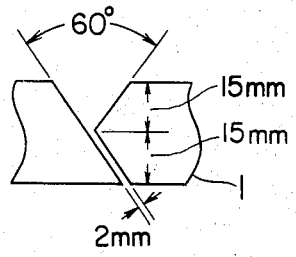
FIG. 2 is a sectional view taken along a line A—A' in FIG. 1.
Figure 3:
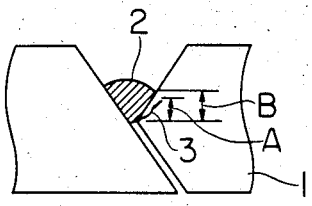
FIG. 3 is a sectional view taken along the line A—A' in the state after welding.

FIG. 2 is a sectional view taken along the line A—A' in FIG. 1, showing the shape of the groove, while FIG. 3 is a sectional view also taken along the line A—A' in FIG. 1, for illustrating particularly the relationship between the weld metal and the SR cracking.

The SR cracking ratio (%) is given by the following formula.

$$\frac{\text{crack length } A \text{ (mm)}}{\text{throat thickness } B \text{ (mm)}} \times 100$$

The SR cracking ratio was obtained as a mean value of the cracking ratios exhibited by 5 (five) segments of the groove portion. The crack is designated at a numeral 3. The chemical composition of the weld metal is shown in Table 2 in terms of weight percents. The balance is Fe.

TABLE 2

| C | Si | Mn | P | S | Cr | Mo | V | Cu | Ni | Sb | Sn | As |
|---|---|---|---|---|---|---|---|---|---|---|---|---|
| 0.03 | 0.69 | 0.63 | 0.005 | 0.008 | 1.98 | 0.87 | tr | — | — | 0.004 | 0.0052 | 0.004 |

TABLE 3

| | |
|---|---|
| Current | 170 (A) |
| Voltage | 22 (V) |
| Welding speed | 11 (cm/min) |
| Preheating temp. | 350 (°C.) |
| SR start temp. | 350 (°C.) |
| SR treatment | 700° C., 9h |

A creep rupture test was conducted by using a creep test piece having a diameter in parallel portion of 10 mm and a length in parallel portion of 50 mm, while maintaining the test temperature within an error of ±1° C.

On the other hand, an impact test was conducted by using a test piece which was prepared in accordance with No. 5 as specified by JIS Z2202.

Table 4 shows the values $\overline{X}$ of the alloys shown in Table 1, 600° C. $10^5$ hour creep rupture strengths, SR cracking ratios and the values $(\overline{X}+\overline{Al})$ of the alloys shown in Table 1. The value $\overline{X}$ was obtained in accordance with the formula mentioned before, while the value $\overline{Al}$ was obtained by multiplying the Al content in terms of ppm by the factor x represented by the axis of ordinate in the graph shown in FIG. 4. For instance, the SR cracking multiplication factor x is 4.0 when the Al content is 0.02 wt%, i.e. 200 ppm. In this case, therefore, the value $\overline{Al}$ is calculated to be 800. In the case of the alloy of Sample No. 3, the value $\overline{X}$ is 1880, and the multiplication factor x is 1.5 because the Al content is 0.083 wt% (830 ppm), so that the value $\overline{Al}$ is calculated to be 1245. The value $(\overline{X}+\overline{Al})$, therefore, is calculated to be 3,125. The value $(\overline{X}+\overline{Al})$ is determined in the manner explained hereinabove.

Figure 5:
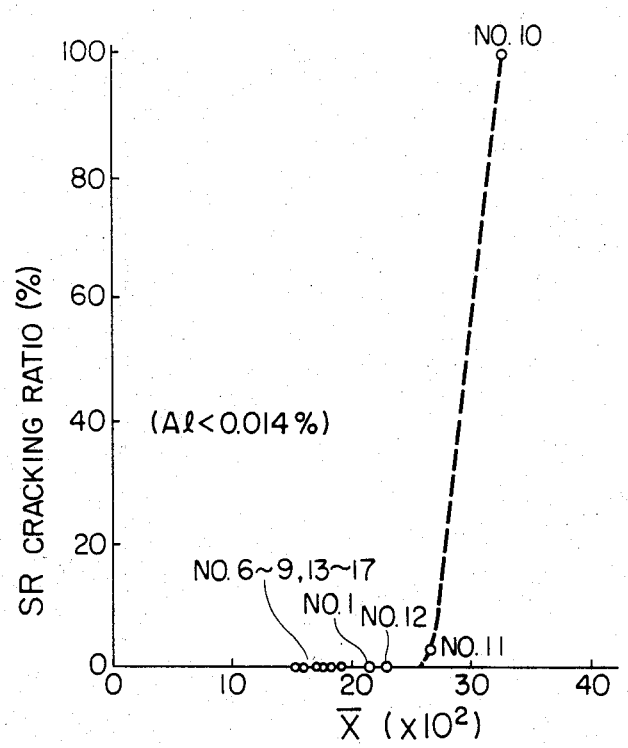
FIG. 5 is a diagram showing the relationship between the SR cracking ratio and a value $\overline{X}$.

FIG. 5 is a diagram showing the relationship between the value $\overline{X}$ and the SR cracking ratio in the steels having Al content not greater than 0.014 wt%.

TABLE 4

| No. | $\overline{X}$ ($\times 10^2$) | 600° C., $10^5$h creep rupture strength (kg/mm$^2$) | SR cracking ratio (%) | $\overline{X}+\overline{Al}$ ($\times 10^2$) |
|---|---|---|---|---|
| 1 | 21.4 | 5.7 | 0 | 21.4 |
| 2 | 18.8 | 10.5 | 3 | 26.4 |
| 3 | 18.8 | 6.3 | 47 | 31.3 |
| 4 | 18.7 | 11.1 | 19 | 29.1 |
| 5 | 18.4 | 10.5 | 6 | 27.2 |
| 6 | 18.8 | 9.7 | 0 | 18.8 |
| 7 | 17.3 | 5.7 | 0 | 17.3 |
| 8 | 15.6 | 9.6 | 0 | 15.6 |
| 9 | 15.6 | 9.7 | 0 | 15.6 |
| 10 | 32.2 | 8.5 | 100 | 32.2 |
| 11 | 26.5 | 9.0 | 3 | 26.5 |
| 12 | 22.9 | 10.0 | 0 | 22.9 |
| 13 | 17.4 | 9.5 | 0 | 17.4 |
| 14 | 17.2 | 9.0 | 0 | 17.2 |
| 15 | 18.7 | 9.3 | 0 | 18.7 |
| 16 | 15.9 | 9.5 | 0 | 15.9 |
| 17 | 17.0 | 9.2 | 0 | 17.0 |

As will be seen from this Figure, the SR cracking ratio is drasticlly increased as the value $\overline{X}$ exceeds 2500.

Figure 6:
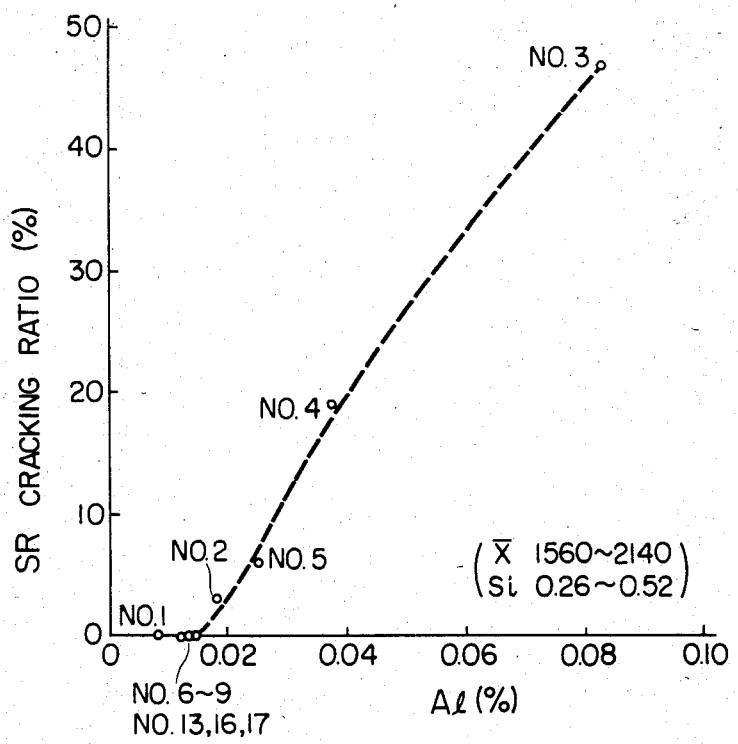
FIG. 6 is a diagram showing the relationship between the SR cracking ratio and the Al content.

FIG. 6 is a diagram showing the relationship between the Al content and SR cracking ratio as obtained with steel having the value $\overline{X}$ ranging between 1560 and 2140 and Si content ranging between 0.26 and 0.52 wt%. As will be seen from this Figure, the SR cracking ratio is drastically increased as the Al content exceeds 0.015 wt%. In order to maintain the SR cracking ratio below 20%, the Al content is preferably selected to be not greater than 0.04 wt%. For maintaining the SR cracking ratio below 10% and 5%, respectively, the Al content should be not greater than 0.028 wt% and 0.019 wt%.

Figure 7:
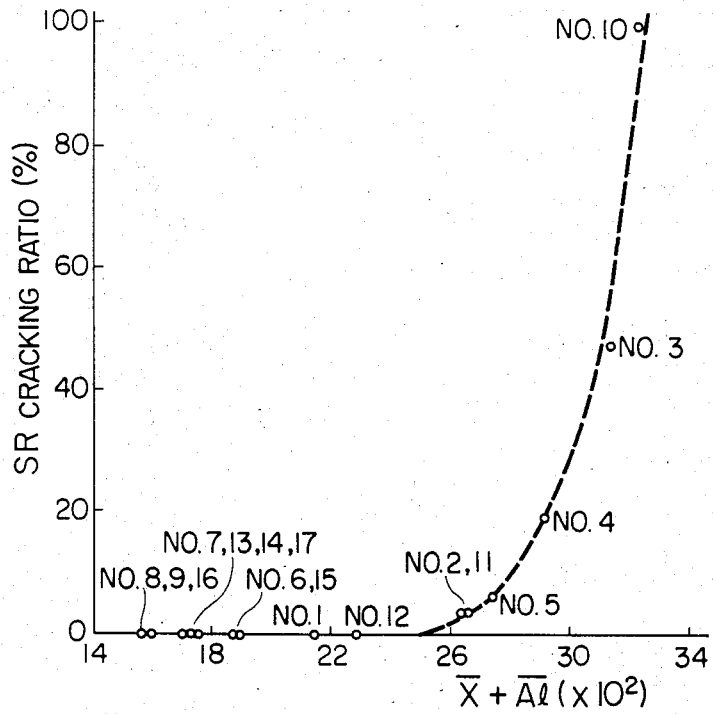
FIG. 7 is a diagram showing the relationship between the SR cracking ratio and the value ($\overline{X}$+Al)

FIG. 7 is a diagram showing the relationship between the value $(\overline{X}+\overline{Al})$ and the SR cracking ratio. As will be seen from this Figure, the SR cracking ratio is increased drastically as the value $(\overline{X}+\overline{Al})$ exceeds 2500. In fact, the SR cracking ratio is almost 100 percents when the value $(\overline{X}+\overline{Al})$ is 3250. For maintaining the SR cracking ratio below 20%, the value $(\overline{X}+\overline{Al})$ should be maintained below 2920.

Figure 8:
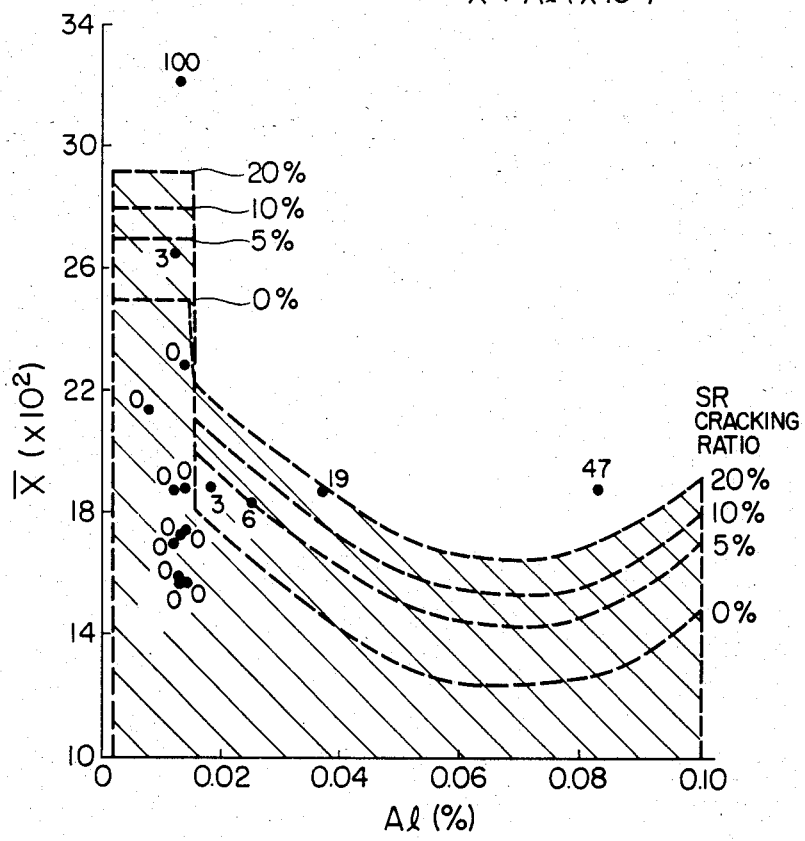
FIG. 8 is a diagram showing how the SR cracking ratio is affected by the $\overline{X}$ and the $\overline{Al}$ content.

FIG. 8 is a diagram showing the effect of interaction between the value $\overline{X}$ and the Al content on the SR cracking ratio. In this Figure, the hatched area shows the region which provides the SR cracking ratio below 20%. As will be seen from FIG. 7, this region corresponds to the value $(\overline{X}+\overline{Al})$ not greater than 2920. From FIG. 8, it will be understood that the Al content can be increased without allowing the SR cracking, provided that the value $\overline{X}$ can be decreased. Namely, the Al content can be increased without suffering from the SR cracking by controlling the value $\overline{X}$ and the Al content such that, Al content is not greater than 0.015 wt% at the value $\overline{X}$ less than 2920, not greater than 0.016 wt% at the value $\overline{X}$ below 2210, not greater than 0.02 wt% at the value $\overline{X}$ below 2130, not grater than 0.03 wt% at the value $\overline{X}$ below 1990, not greater than 0.04 wt% at the value $\overline{X}$ below 1840, not greater than 0.06 wt% at the value $\overline{X}$ below 1720, not greater than 0.07 wt% at the value $\overline{X}$ below 1640, not greater than 0.08 wt% at the value $\overline{X}$ below 1680, not greater than 0.09 wt% at the value $\overline{X}$ below 1770, not greater than 0.10 wt% at the value $\overline{X}$ below 1920.

The same applies also to the case where the SR cracking ratio is 0 percent, 5 percents and 10 percents as shown in FIG. 7. Namely, the value $(\overline{X}+\overline{Al})$ is 2500, 2700 and 2800 when the SR cracking ratio is 0 percent, 5 percents and 10 percents.

Figure 9:
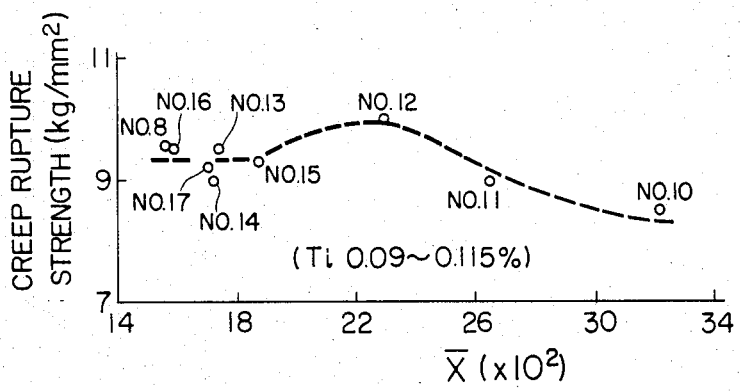
FIG. 9 is a diagram showing the relationship between the creep rupture strength and the value $\overline{X}$.

FIG. 9 shows the relationship between the 600° C. $10^5$ hour creep rupture strength and the value $\overline{X}$ as observed in steels having Ti content ranging between 0.09 and 0.115 wt% and an Al content not greater than 0.014 wt%. The creep rupture strength is affected by the contents of impurities. Namely, the strength is decreased as the contents of the impurities are increased, but a high strength of not smaller than 9 Kg/mm$^2$ is obtainable when the value $\overline{X}$ is below 2700.

Figure 10:
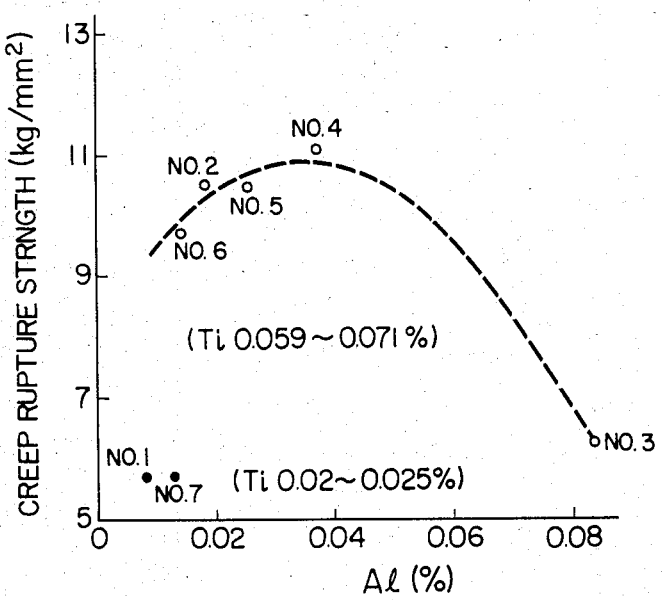
FIG. 10 is a diagram showing the relationship between the creep rupture strength and the Al content.

FIG. 10 is a diagram showing the relationship between the 600° C. $10^5$ hour creep rupture strength as obtained with steels having Ti content ranging between 0.059 and 0.071 wt% and a value $\overline{X}$ ranging between 1640 and 1880. Containment of excessive amount of Al causes a drastic reduction in the strength. A strength as high as 8 Kg/mm$^2$ is obtainable when the Al content ranges between 0.002 and 0.07 wt%, and a still higher strength of 9 Kg/mm$^2$ is obtainable with the Al content ranging between 0.005 and 0.065 wt%. A strength not smaller than about 4.5 Kg/mm$^2$ is obtainable with the Al content of not greater than 0.1 wt%. Higher strength can be obtained by increasing the Ti and B contents.

Figure 11:
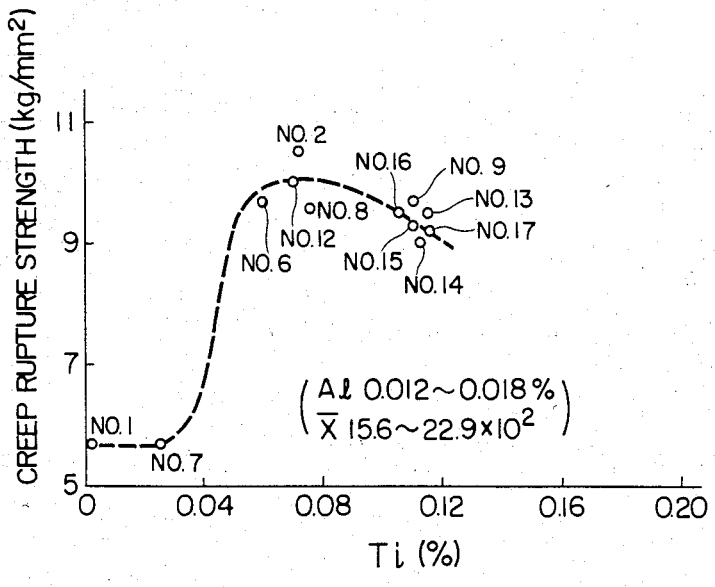
FIG. 11 is a diagram showing the relationship between the creep rupture strength and the Ti content.

FIG. 11 shows the relationship between the 600° C. $10^5$ hour creep rupture strength and the Ti content as observed with steels having Al content ranging between 0.012 and 0.018 wt% and value $\overline{X}$ ranging between 1560 and 2290. It will be seen that the creep rupture strength can be increased remarkably by the addition of Ti. Particularly, a high strength of 7 Kg/mm$^2$ or greater is obtained with the Ti content ranging between 0.04 and 0.16 wt%. Higher strengths of not smaller than 8 Kg/mm$^2$ and not smaller than 9 Kg/mm$^2$ are obtainable, respectively, with the Ti contents ranging between 0.045 and 0.14 wt% and between 0.05 and 0.12 wt%. With these Ti contents, a higher strength can be obtained by selecting the Al content to range between 0.01 and 0.065 wt%. The increase in the Al content, however, should be made to make the value $\overline{X}$ fall within the preferred ranges explained before.

Figure 12:
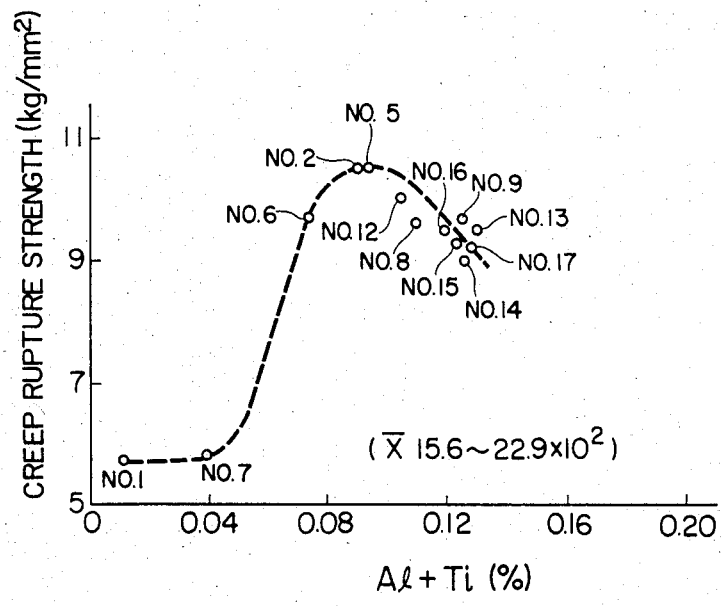
FIG. 12 is a diagram showing the relationship between the creep rupture strength and the (Al+Ti) content.

FIG. 12 shows the relationship between the 600° C. $10^5$ hour creep rupture strength and the (Al+Ti) content as observed in steels having Al content of not greater than 0.025 wt% and value $\overline{X}$ ranging between 1560 and 2290. It will be seen that the strength can be improved remarkably by the addition of Al and Ti in combination. Strengths of not smaller than 8 Kg/mm$^2$ and not smaller than 9 Kg/mm$^2$ are obtained when the (Al+Ti) content ranges between 0.06 and 0.15 wt% and between 0.09 and 0.13 wt%, respectively. When the (Al+Ti) content is 0.056 wt% or greater, a strength of 7 Kg/mm$^2$ or greater is obtained.

Figure 13:
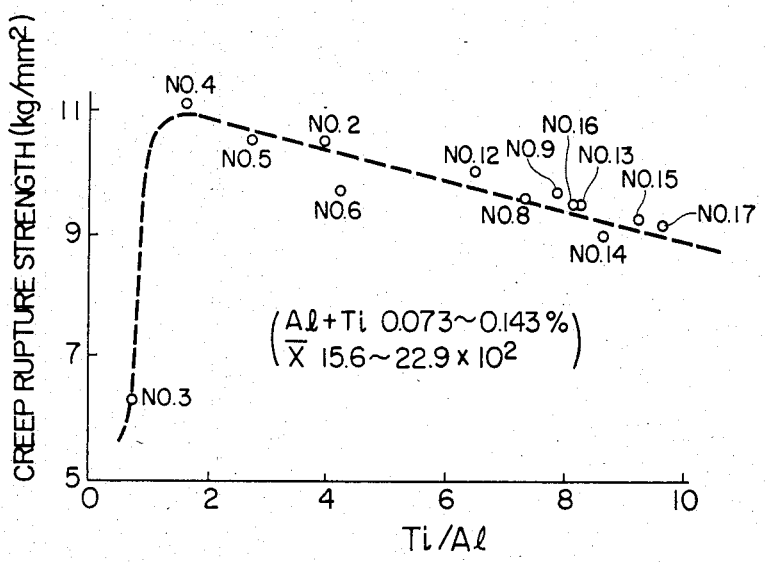
FIG. 13 is a diagram showing the relationship between the creep rupture strength and the ratio (Ti/Al)

FIG. 13 is a diagram showing the relationship between the 600° C. $10^5$ hour creep rupture strength and the ratio (Ti/Al) as observed with steels having (Al+Ti) content of 0.073 to 0.143 wt% and value $\overline{X}$ ranging between 1560 and 2290. The creep rutpure strength is significantly affected by the ratio (Ti/Al). A strength of not smaller than 8 Kg/mm$^2$ can be obtained by selecting the ratio (Ti/Al) to range between 0.8 and 14. The strength can be further increased to 9 Kg/mm$^2$ or greater by increasing the ratio to a level ranging between 0.9 and 9.5.

Figure 14:
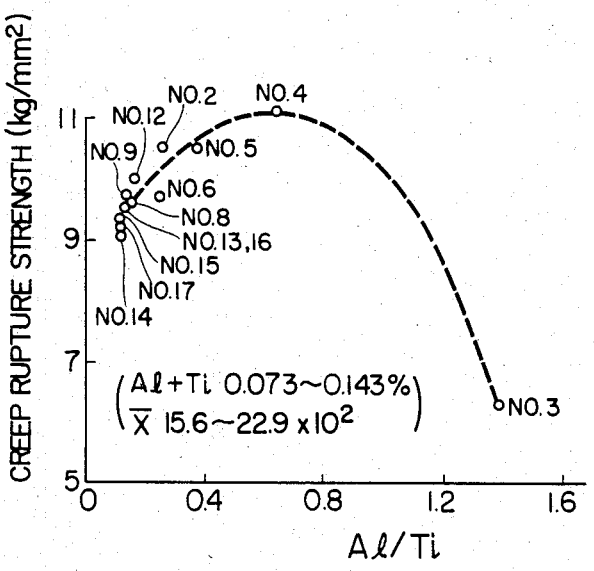
FIG. 14 is a diagram showing the relationship between the creep rupture strength and the ratio (Al/Ti)

FIG. 14 is a diagram showing the relationship between the 600° C. $10^5$ hour creep rupture strength and the ratio (Al/Ti) as observed in steels having (Al+Ti) content ranging between 0.073 and 0.143 wt% and the value $\overline{X}$ ranging between 1560 and 2290. The creep rupture strength is significantly affected also by the ratio (Al/Ti). Namely, strengths of not smaller than 8 Kg/mm$^2$ and not smaller than 9 Kg/mm$^2$ are obtainable with the ratio (Al/Ti) ranging between 0.07 and 1.25 and between 0.10 and 1.15, respectively.

Figure 15:
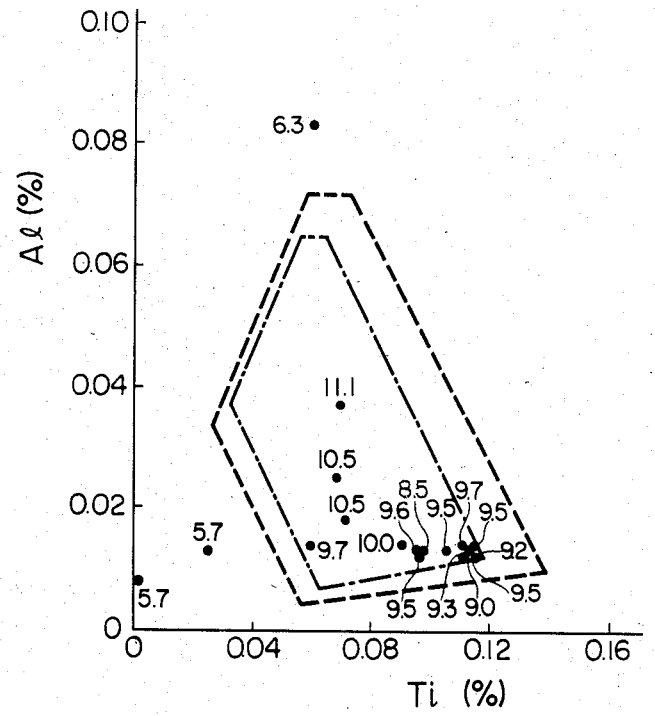
FIG. 15 is a diagram showing how the creep rupture strength is affected by the Ti content and the Al content.

FIG. 15 is a diagram showing how the 600° C. $10^5$ hour creep rupture strength is affected by the Al and Ti contents. In view of the conditions as explained in connection with FIGS. 10 to 14, it is possible to obtain a strength of not smaller than 8 Kg/mm$^2$ by selecting the Al content and the Ti content to fall within the region surrounded by the broken lines. A higher strength of not smaller than 9 Kg/mm$^2$ is obtainable by selecting these contents to fall within the region surrounded by the chain lines. More specifically, the first-mentioned region is defined by straight lines connecting the points (0.056 wt% Ti, 0.004 wt% Al), (0.026 wt% Ti, 0.034 wt% Al), (0.058 wt% Ti, 0.072 wt% Al), (0.074 wt% Ti, 0.072 wt% Al) and (0.14 wt% Ti, 0.01 wt% Al), while the second-mentioned region is defined by straight lines connecting the points (0.063 wt% Ti, 0.007 wt% Al), (0.032 wt% Ti, 0.038 wt% Al), (0.056 wt% Ti, 0.065 wt% Al), (0.065 wt% Ti, 0.065 wt% Al) and (0.117 wt% Ti, 0.012 wt% Al). By selecting the ratio (Ti/Al) in these regions to range between 0.8 and 14, it is possible to obtain a satisfactorily high strength. A higher strength can be obtained by selecting the same ratio to range between 0.9 and 9.5.

Nowadays, the casings of steam turbines for thermal power generation are required to have a $10^5$ creep rupture strength of not smaller than 9 Kg/mm$^2$ at 538° C. For higher steam temperatures, the composition should be adjusted to maintain the creep rupture strength of not smaller than 9 Kg/mm$^2$, in accordance with the elevated steam temperature.

Figure 16:
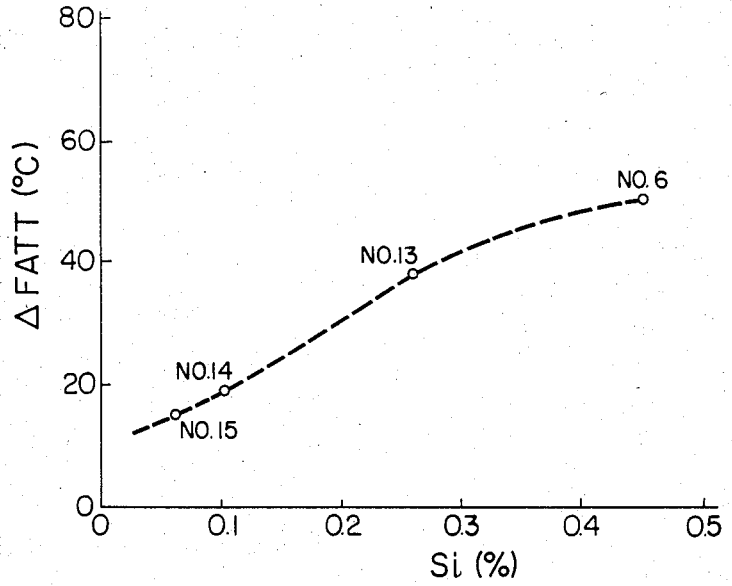
FIG. 16 is a diagram showing the relationship between the ΔFATT and the Si content.

FIG. 16 is a diagram showing the relationship between the Si content and the value Δ FATT which is determined in accordance with the following formula from values obtained through an impact test. Each of the test pieces was held at an elevated temperature of 500° C. for 3,000 hours and was subjected to an impact test at temperature between −20° and +150° C. Then the value Δ FATT was obtained from the fracture of the test piece, in accordance with the following formula.

$$\Delta FATT = To - Tt$$

where, To is the 50% brittle fracture transition temperature (°C.) before heating, while Tt represents the 50% brittle fracture transition temperature (°C.) of material embrittled by heating.

As will be seen from this Figure, the value Δ FATT is decreased in accordance with the reduction in the Si content. For instance, the value Δ FATT is about 15° C. when the Si content is 0.06 wt%. This means that the amount of embrittlement is decreased remarkable. The Si content of the steel in accordance with the invention, therefore, should be made as small as possible within the range practically allowed in the manufacture.

The materials of samples Nos. 16 and 17 containing Zr and Ca showed no defects such as below hole in the ingot, owing to the strong deoxidation effect produced by Ca and Zr. Thus, the ingots of these materials were quite sound and did not show at all any SR cracking. In addition, these materials showed high creep rupture strengths of not smaller than 9 Kg/mm$^2$.

Some of the sample materials shown in Table were subjected to a tensile test conducted at room temperature, and showed tensile strength of not smaller than 56 Kg/mm$^2$, elongations of not smaller than 15% and a reduction in area of not smaller than 50%.

EXAMPLE 2

Ingots of the same size as those in Example 1 were produced from the materials having chemical compositions (wt%) as shown in Table 5. More specifically, the sample materials were prepared by the following processes. Namely, the starting materials were refined in an electric arc furnace within the atmospheric air, and were poured into ladle. The steel ingots of samples Nos. 21 and 22 were obtained by vacuum casting immediately after the refining, while those of samples Nos. 23 to 29 were obtained by a process having the steps of effecting a degassing and floating of oxides by reducing the pressure on the ladle down to 1 Torr. or lower while blowing Ar gas from the ladle bottom, heating the melt by arc while blowing again Ar gas from the ladle bottom and then effecting, as in the case of sample Nos. 21 and 22, a vacuum casting.

TABLE

| | No. | C | Si | Mn | P | S | Cu | Ni | Cr | Mo | V | Al | Ti | Sn | As | Sb | Others | Al + Ti |
|---|---|---|---|---|---|---|---|---|---|---|---|---|---|---|---|---|---|---|
| Comparison steel | 21 | 0.12 | 0.43 | 0.70 | 0.010 | 0.009 | 0.13 | 0.24 | 1.48 | 1.10 | 0.20 | 0.010 | 0.023 | 0.013 | 0.011 | 0.0021 | — | 0.033 |
| Steel of invention | 22 | 0.12 | 0.28 | 0.69 | 0.012 | 0.007 | 0.14 | 0.24 | 1.50 | 1.10 | 0.22 | 0.010 | 0.025 | 0.015 | 0.013 | 0.0022 | — | 0.035 |
| Steel of invention | 23 | 0.11 | 0.15 | 0.68 | 0.011 | 0.007 | 0.13 | 0.21 | 1.48 | 1.13 | 0.21 | 0.011 | 0.025 | 0.015 | 0.013 | 0.0021 | — | 0.036 |
| Steel of invention | 24 | 0.14 | 0.07 | 0.54 | 0.017 | 0.009 | 0.12 | 0.22 | 1.33 | 1.15 | 0.16 | 0.008 | 0.032 | 0.011 | 0.012 | 0.0018 | — | 0.040 |
| Comparison steel | 25 | 0.13 | 0.08 | 0.56 | 0.030 | 0.010 | 0.11 | 0.26 | 1.45 | 1.15 | 0.16 | 0.009 | 0.022 | 0.011 | 0.011 | 0.0020 | — | 0.031 |
| Comparison steel | 26 | 0.13 | 0.08 | 0.70 | 0.018 | 0.011 | 0.12 | 0.23 | 1.34 | 1.12 | 0.17 | 0.008 | 0.021 | 0.013 | 0.013 | 0.019 | — | 0.029 |
| Steel of invention | 27 | 0.12 | 0.07 | 0.67 | 0.018 | 0.011 | 0.13 | 0.25 | 1.50 | 1.13 | 0.16 | 0.009 | 0.021 | 0.018 | 0.013 | 0.0020 | — | 0.030 |
| Steel of invention | 28 | 0.11 | 0.08 | 0.65 | 0.008 | 0.008 | 0.14 | 0.23 | 1.35 | 1.10 | 0.17 | 0.008 | 0.023 | 0.007 | 0.011 | 0.0012 | — | 0.031 |
| Steel of invention | 29 | 0.13 | 0.07 | 0.68 | 0.012 | 0.008 | 0.13 | 0.23 | 1.40 | 1.13 | 0.19 | 0.008 | 0.025 | 0.011 | 0.013 | 0.0020 | Ca 0.002 Zr 0.05 | 0.033 |

The ingots were subjected to a hardening which was conducted by holding the ingots at 1,050° C. for 9 hours followed by cooling at a rate of 400° C./h. After the hardening, the ingots were tempered by being held at 710° C. for 15 hours followed by air cooling.

The creep crack developing test was conducted using test pieces having notches in their side surfaces and having a thickness of 14 mm, breadth of 30 mm and a length of 140 mm. The notch was formed by machining to have a depth of 6 mm, breadth of 1 mm and an apex angle of 45°. The test pieces were then subjected to a bending vibration fatigue test to produce cracks of 1 mm deep. The notches in test pieces of both-groove type has a depth of 2 mm and an apex angle of 60°.

The creep crack developing test was conducted at a constant temperature of 550° C. The crack length was measured by electric potential method which makes use of the fact that the electric resistance is increased in accordance with the development of the crack.

The crack developing speed can be determined in accordance with the following formula.

Namely, the crack developing speed as obtained under the condition of KI (stress increment factor)=90 Kg mm$^{-3/2}$ is determined by a diagram which shows the relationship between the test time length and the crack length.

$$KI = Y \cdot P\sqrt{a}\,/BW\ (\text{Kg mm}^{-3/2})$$

-continued $$Y = 1.99 - 0.41\,(a/W) + 18.7\,(a/W)^2$$

Where, P: load (Kg), B: breadth of test piece (mm), W: thickness of test piece (mm) and a: crack depth (mm).

As will be understood from the formula shown above, the value of KI varies depending on the crack depth. The load was varied in accordance with the composition of the test material within the range of between 2900 and 3250 Kg.

TABLE 6

| No. | X (× 10²) | X + Si (× 10²) | Crack developing speed (mm/h) | 538° C. 10⁵ hour creep rupture strength (Kg/mm²) |
|---|---|---|---|---|
| 21 | 17.4 | 33.9 | $30.5 \times 10^{-3}$ | 12.3 |
| 22 | 20.4 | 27.4 | $5.7 \times 10^{-3}$ | 12.0 |
| 23 | 19.4 | 22.3 | $2.3 \times 10^{-3}$ | 12.5 |
| 24 | 23.5 | 24.7 | $2.0 \times 10^{-3}$ | 13.0 |
| 25 | 36.5 | 37.9 | $66.5 \times 10^{-3}$ | 10.5 |
| 26 | 34.0 | 35.4 | $40.5 \times 10^{-3}$ | 11.2 |
| 27 | 27.5 | 28.7 | $8.3 \times 10^{-3}$ | 11.8 |
| 28 | 12.5 | 13.9 | $1.9 \times 10^{-3}$ | 13.5 |
| 29 | 18.7 | 19.9 | $2.3 \times 10^{-3}$ | 12.3 |

Among the materials, the samples Nos. 21, 25 and 26 are comparison materials while the samples Nos. 22 to 24 and Nos. 27 to 29 are materials of the invention. Table 6 shows the value $\overline{X}$, value $(\overline{X}+\overline{Si})$, crack developing speed and the creep rutpure strength. The value $\overline{X}$ is calculated in the same way as that explained before, while $\overline{Si}$ is given by the following formula, expressing the Si content in terms of ppm.

$$\overline{Si} = Si/y$$

Figure 17:
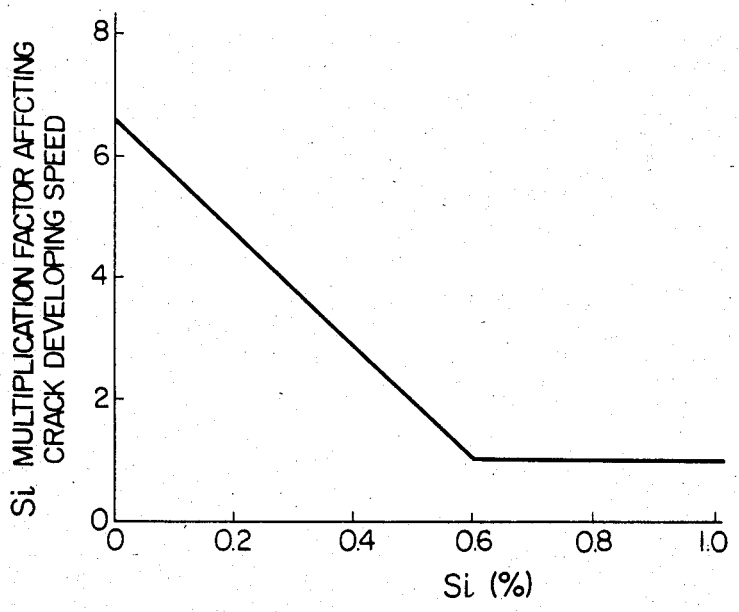
FIG. 17 is a diagram showing the relationship between the Si multiplication factor (y) affecting the crack developing speed and the Si content.

Where, y represents a coefficient which is determined from FIG. 17.

The coefficient y varies depending on the Si content. More specifically, the coefficient takes values of 6.5 at Si content of 0.01 wt%, 5.65 at 0.1 wt%, 4.75 at 0.2 wt%, 3.8 at 0.3 wt%, 2.9 at 0.4 wt%, 2.0 at 0.5 wt% and 1 at 0.6 wt% or greater.

In the steel of this embodiment, the value $(\overline{X}+\overline{Al})$ equals to the value $\overline{X}$.

In FIG. 17 shows the Si multiplication factory y which affects the crack developing speed. Thus, the value of the coefficient y can be determined from this Figure.

Figure 18:
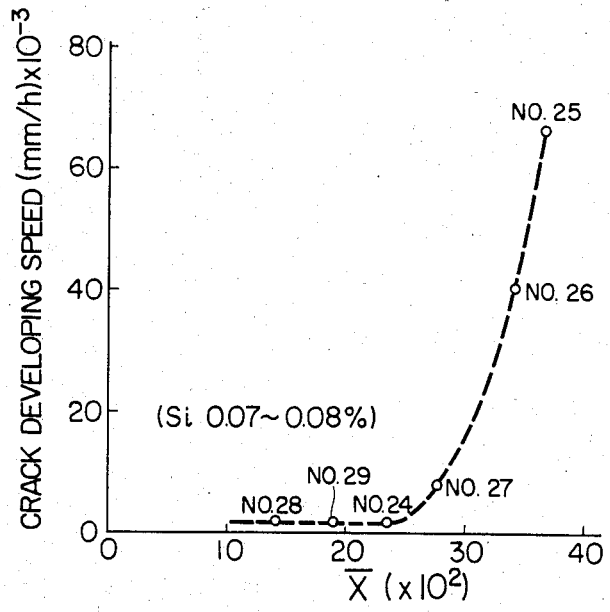
FIG. 18 is a diagram showing the relationship between the crack developing speed and the value $\overline{X}$.

FIG. 18 shows the relationship between the crack developing speed and the value $\overline{X}$ as observed in a steel having an Si content ranging between 0.07 and 0.08 wt%. In order to maintain the crack developing speed not higher than $20\times10^{-3}$ (mm/h) within the limited range of Si content of between 0.07 and 0.08 wt%, it is necessary that the value $\overline{X}$ is below 3100. For maintaining the crack developing speed below $10\times10^{-3}$ mm/h and below $5\times10^{-3}$ mm/h, respectively, it is preferred that the value $\overline{X}$ falls below 2850 and below 2500.

Figure 19:
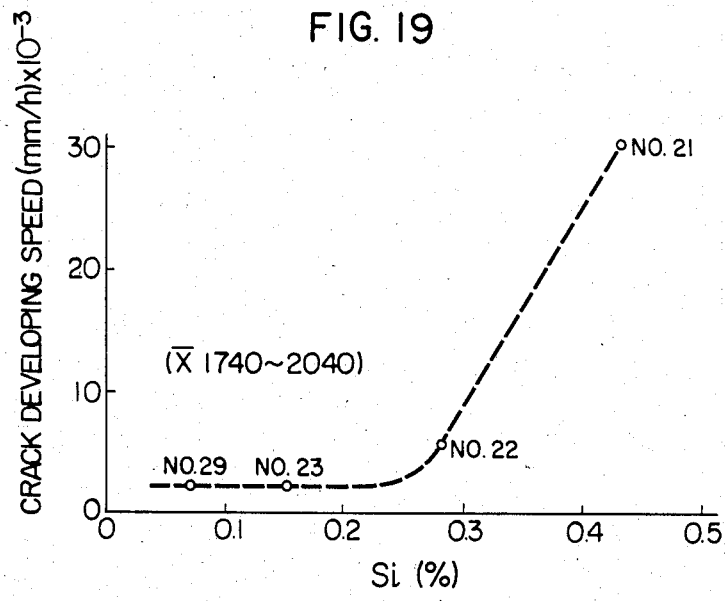
FIG. 19 is a graph showing the relationship between the crack developing speed and the Si content.

FIG. 19 is a diagram showing the relationship between the crack developing speed and the Si content as observed with a steel having the $\overline{X}$ value ranging between 1740 and 2040. From this Figure, it will be understood that the Si content is preferable selected to be not greater than 0.37 wt%, in order to maintain the crack developing speed of not greater than $20\times10^{-3}$ (mm/h). Similarly, for attaining the crack developing speeds of not greater than $10\times10^{-3}$ (mm/h), $5\times10^{-3}$ (mm/h) and $2.5\times10^{-3}$ (mm/h), respectively, the Si content should be selected to be not greater than 0.30 wt%, not greater than 0.27 wt% and not greater than 0.25 wt%.

Figure 20:
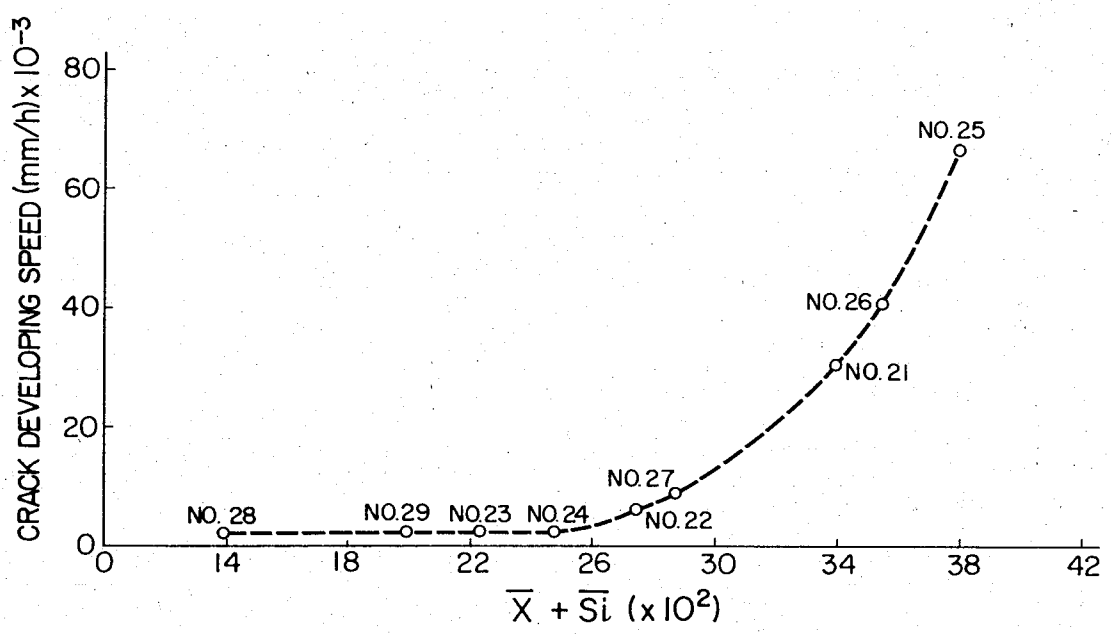
FIG. 20 is a diagram showing the relationship between the crack developing speed and the value ($\overline{X}$+$\overline{Si}$)

FIG. 20 shows the relationship between the crack developing speed and the value $(\overline{X}+\overline{Si})$. The crack developing speed is drastically increased as the value $(\overline{X}+\overline{Si})$ is increased beyond 2600. A crack developing speed of not greater than $20\times10^{-3}$ (mm/h) can be obtained by selecting the value $(\overline{X}+\overline{Si})$ to be not greater than 3200. Similarly, the crack developing speeds of not greater than $10\times10^{-3}$ (mm/h), $5\times10^{-3}$ (mm/h) and $2.5\times10^{-3}$ (mm/h) can be obtained respectively, by selecting the value $(\overline{X}+\overline{Si})$ to be not greater than 2900, not greater than 2700 and not greater than 2600.

Figure 21:
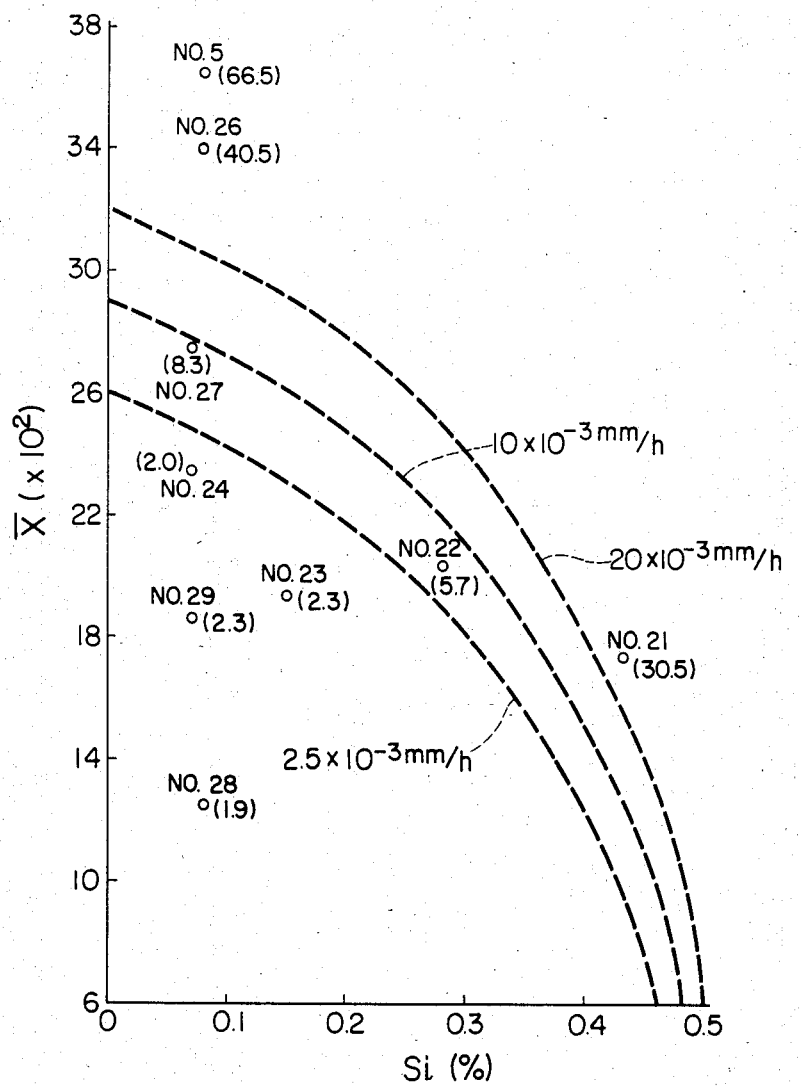
FIG. 21 is a diagram showing how the crack developing speed is affected by the value $\overline{X}$ and the Si content.

FIG. 21 is a diagram showing how the crack developing speed is affected by the value $\overline{X}$ and the Si content. The crack developing speed is increased by a simultaneous increase in the value $\overline{X}$ and the Si content. That is, the value $\overline{X}$ and the Si content are inverse proportion to each other. Numerals apearing in the parentheses in this Figure show the crack developing speed ($\times10^{-3}$ mm/h).

The broken-line curves in this Figure show the upper limits of the value $\overline{X}$ and Si content for obtaining respective crack developing speeds of $2.5\times10^{-3}$ (mm/h), $10\times10^{-3}$ (mm/h) and $20\times10^{-3}$ (mm/h).

EXAMPLE 3

Figure 22:
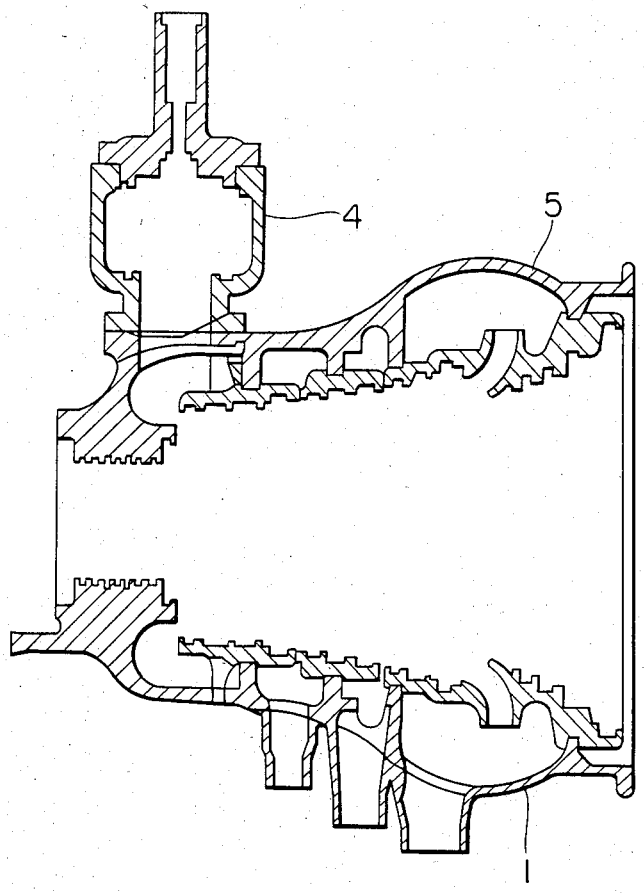
FIG. 22 is a sectional view of the casing body of a steam turbine for a thermal power generation.
Figure 23:
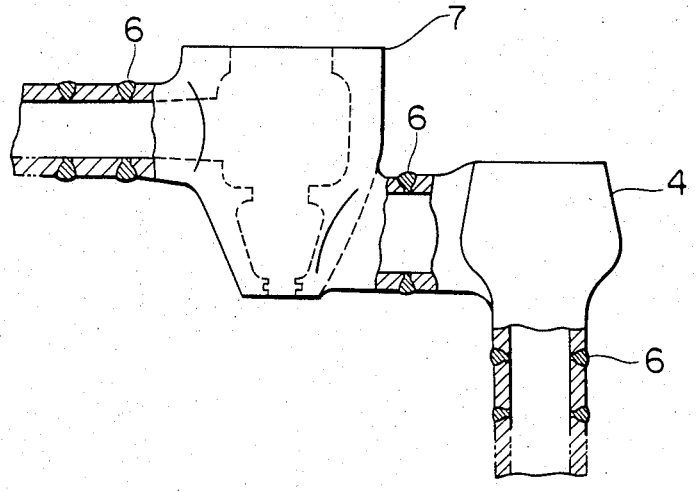
FIG. 23 is a plan view of casings of a steam regulating valve and a main steam stop valve.

FIG. 22 is a sectional view of the body 5 of a casing of a steam turbine for thermal power generation, while FIG. 23 shows a steam regulating valve casing 4 and a main steam stop valve casing 7 on the turbine casing. The casing body 5 is formed by casting, while the valve casings 4 and 7 are formed either by casting or forging.

The steel in accordance with the invention can suitably be used as the materials of these casing body 5 and valve casings 4 and 7. By way of example, the inventors have considered the use of steels having compositions as shown in Table 7. In this Table, compositions are shown in terms of weight percents. More specifically, the steel containing B was used for the main steam stop valve casing, steam regulating valve casing and the inner casing body, while the steels containing or not containing B were cased as the materials of the outer casing body. The main steam stop valve casing and the steam regulating valve casing were forgings.

Table 8 shows the value $\overline{X}$, value $(\overline{X}+\overline{Al})$, value $(\overline{X}+\overline{Si})$, value (Al+Ti) and the ratio (Ti/Al) of the steels shown in Table 7. It will be seen that the steel containing B shows a small cracking ratio of about 5 percents, and a small crack developing speed of about $2.5\times10^{-3}$ (mm/h) can be obtained even with the steel containing no B.

TABLE 7

| | C | Si | Mn | P | S | Ni | Cr | Mo | V | Al | Ti | B | Sb | Sn | As | Cu |
|---|---|---|---|---|---|---|---|---|---|---|---|---|---|---|---|---|
| Containing B | 0.14 | 0.42 | 0.31 | 0.016 | 0.006 | 0.14 | 1.33 | 1.12 | 0.23 | 0.016 | 0.042 | 0.0006 | 0.0012 | 0.007 | 0.009 | 0.09 |
| Not containing B | 0.13 | 0.07 | 0.54 | 0.014 | 0.006 | 0.22 | 1.33 | 1.15 | 0.16 | 0.008 | 0.022 | 0.0003 | 0.0018 | 0.011 | 0.012 | 0.12 |

TABLE 8

| | $\overline{X}$ ($\times10^2$) | $\overline{X}+\overline{Al}$ ($\times10^2$) | Al + Ti | Ti/Al | $\overline{X}+\overline{Si}$ |
|---|---|---|---|---|---|
| Containing B | 20.3 | 27.3 | 0.058 | 2.63 | — |
| Not containing B | 20.5 | 20.5 | 0.030 | 2.75 | 21.7 |

The welding is conducted on the points 6 as illustrated in FIG. 23.

Figure 24:
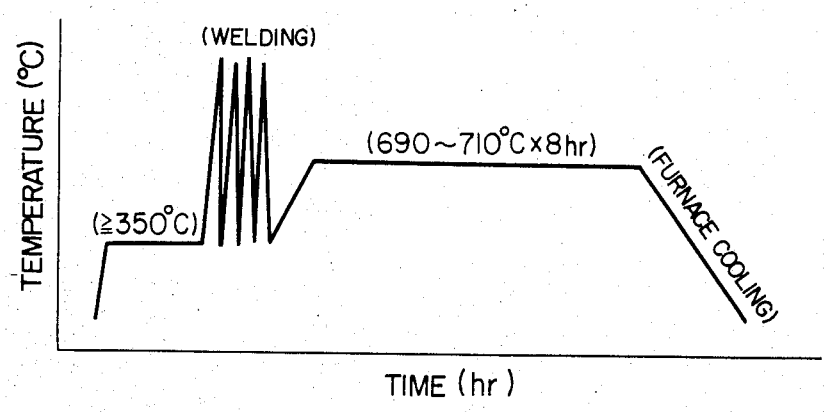
FIG. 24 is a diagram showing a process including welding and treatment after the welding.

FIG. 24 is a diagram showing the preheating temperature for the welding shown in FIG. 23, as well as the stress relief treatment (at 690° to 710° C. for 8 hours) after the welding. Weld metal having same composition as shown in Table 2 was employed in this welding. The preheating temperature is 350° C., and the heating in the stress relief treatment is commenced at a temperature of 350° C. After the stress relief treatment, the welded material is cooled by furnace cooling.

Figure 25:
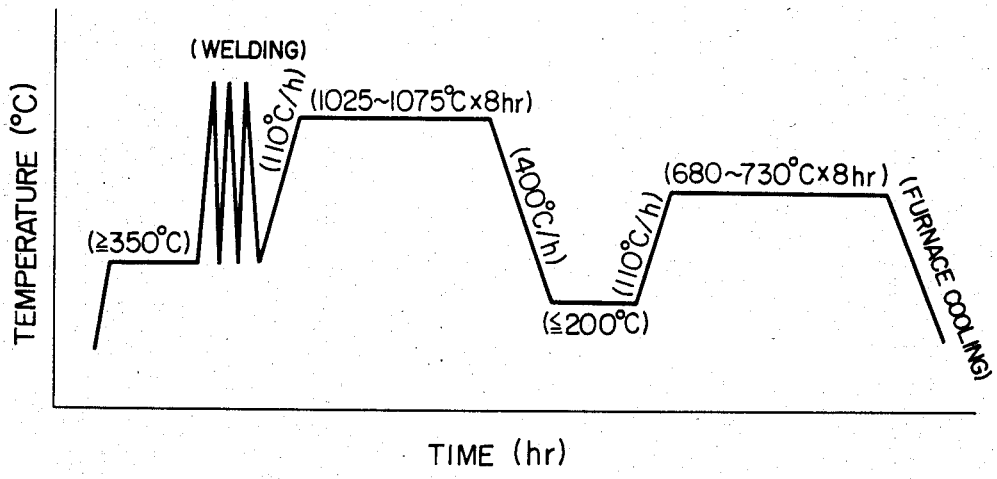
FIG. 25 is a diagram showing a welding process for repairing.

FIG. 25 is a diagram showing the process of the welding for repairing purpose. The welding is conducted after a preheating up to 350° C. After the welding, the welded material is heated at a rate of 110° C./h and is held at 1025° to 1075° C. for 8 hours, followed by a cooling at a rate of 400° C./h. Then, when the temperature has come down to 200° C., a tempering is conducted by holding the material at 680° to 730° C. for 8 hours followed by a furnace cooling. In the repair welding, the weld metal having the composition shown in Table 9 was employed. In this Table, the composition is shown in terms of weight percents, and the balance is Fe.

TABLE 9

| C | Si | Mn | P | S | Cr | Mo | V | Cu | Ni | Sb | Sn | As |
|---|---|---|---|---|---|---|---|---|---|---|---|---|
| 0.08 | 0.57 | 0.88 | 0.014 | 0.004 | 0.56 | 0.14 | 0.18 | 0.01 | 0.02 | 0.003 | 0.0018 | 0.005 |

It is clear that no stress relief cracking takes place in the welding operation stated above.

As will be understood from the foregoing description, the present invention provides a superior heat resisting steel which does not suffer from cracking in the stress relief annealing after welding and which exhibits only a small crack developing speed.

What is claimed is:

1. A heat resisting steel exhibiting a 600° C., $10^5$-hour creep rupture strength higher than 8 Kg/mm$^2$ and having a composition consisting essentially of 0.05 to 0.2 wt% of C, 0.5 to 2.0 wt% of Cr, 0.5 to 2.0 wt% of Mo, 0.05 to 0.5 wt% of V, 0.002 to 0.1 wt% of Al, 0.0002 to 0.0030 wt% of B, 0.045 to 0.15 wt% of Ti and the balance substantially Fe and inevitable impurities, wherein the ratio Ti/Al between the Al content and the Ti content is from 0.8 to 14 and the sum of $\overline{X}$ and $\overline{Al}$ as obtained from the following formulae is not greater than 2920:

$$\overline{X}=10P+5Sb+4Sn+As$$

$$\overline{Al}=xAl$$

Figure 4:
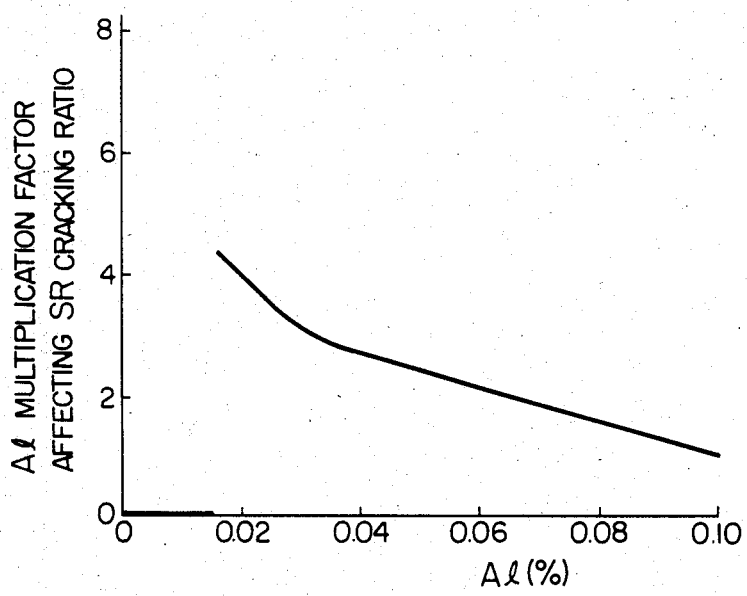
FIG. 4 is a diagram showing the relationship between the Al content and the Al multiplication factor affecting the SR cracking ratio.

(x being a coefficient obtained from FIG. 4)

where P, Sb, Sn and As represent the contents of P, Sb, Sn and As contained as said inevitable impurities in terms of ppm, while Al represents the Al content in terms of ppm.

2. A heat resisting steel according to claim 1 having a composition consisting essentially of 0.05 to 0.2 wt% of C, 0.5 to 2.0 wt% of Cr, 0.5 to 2.0 wt% of Mo, 0.05 to 0.5 wt% of V, 0.002 to 0.015 wt% of Al, 0.0002 to 0.0030 wt% of B and the balance substantially Fe and inevitable impurities, wherein said value $\overline{X}$ is not greater than 2600.

3. A heat resisting steel according to claim 1, having a composition consisting essentially of 0.08 to 0.15 wt% of C, 0.9 to 1.7 wt% of Cr, 0.8 to 1.3 wt% of Mo, 0.1 to 0.35 wt% of V, 0.005 to 0.07 wt% of Al, 0.0005 to 0.0020 wt% of B and the balance substantially Fe.

4. A heat resisting steel according to any one of claims 1 to 3, characterized by having a 600° C. $10^5$ hr creep rupture strength of not smaller than 7 Kg/mm$^2$.

5. A heat resisting steel according to any one of claims 1 to 3, characterized by having a 600° C. $10^5$ hr creep rupture strength of not smaller than 9 Kg/mm$^2$.

6. A heat resisting steel exhibiting a 600° C., $10^5$-hour creep rupture strength higher than 8 Kg/mm$^2$ and having a composition consisting essentially of 0.05 to 0.2 wt% of C, 0.5 to 2.0 wt% of Cr, 0.5 to 2.0 wt% of Mo, 0.05 to 0.5 wt% of V, not greater than 1 wt% of Si, not greater than 2 wt% of Mn, not greater than 0.5 wt% of Ni, 0.002 to 0.1 wt% of Al, 0.045 to 0.15 wt% of Ti, 0.0003 to 0.0030 wt% of B and the balance substantially Fe and inevitable impurities, wherein the ratio Ti/Al between the Al content and the Ti content is from 0.8 to 14 and the sum of $\overline{X}$ and $\overline{Al}$ as obtained from the following formulae is not greater than 2920:

$$\overline{X}=10P+5Sb+4Sn+As$$

$$\overline{Al}=xAl$$

(x being a coefficient obtained from FIG. 4)

where P, Sb, Sn and As represent the contents of P, Sb, Sn and As contained as said inevitable impurities in terms of ppm, while Al represents the Al content in terms of ppm.

7. A heat resisting steel according to claim 6, wherein the Al content ranges between 0.002 and 0.015 wt%, and said value $\overline{X}$ is not greater than 2600.

8. A heat resisting steel according to claim 1, wherein the Al content ranges between 0.002 and 0.07 wt%, and the Ti content ranges between 0.05 and 0.12 wt%.

9. A heat resisting steel according to claim 6, wherein the Al content ranges between 0.01 and 0.02 wt%, and the Ti content ranges between 0.045 and 0.15 wt%.

10. A heat resisting steel according to any one of claims 6 to 9, wherein the sum of the Al and Ti contents ranges between 0.06 and 0.15 wt%, and the value $\overline{X}$ ranges between 1000 and 2500.

11. A heat resisting steel according to any one of claims 6 to 9, having a composition consisting essentially of 0.08 to 0.15 wt% of C, 0.9 to 1.7 wt% of Cr, 0.8 to 1.3 wt% of Mo, 0.1 to 0.35 wt% of V, 0.15 to 0.75 wt% of Si, 0.2 to 0.6 wt% of Mn, 0.1 to 0.3 wt% of Ni, 0.005 to 0.07 wt% of Al, 0.045 to 0.15 wt% of Ti, 0.0005 to 0.0020 wt% of B and the balance substantially Fe.

12. A heat resisting steel according to any one of claims 6 to 9, wherein the Al and Ti contents are within the range within the area which is formed by connecting the following points in FIG. 15 by straight lines: (0.004 wt% Al, 0.056 wt% Ti); (0.034 wt% Al, 0.026 wt% Ti); (0.72 wt.% Al, 0.058 wt% Ti) (0.072 wt% Al, 0.074 wt% Ti); and (0.01 wt% Al, 0.14 wt% Ti).

13. A heat resisting steel according to any one of claims 6 to 9, characterized by having a whole tempered bainite structure.

14. A heat resisting steel according to any one of claims 6 to 9, wherein said steel is a cast steel.

15. A heat resisting steel exhibiting a 600° C., $10^5$-hour creep rupture strength higher than 8 Kg/mm$^2$ and having a composition consisting essentially of 0.05 to 0.2 wt% of C, 0.5 to 2.5 wt% of Cr, 0.5 to 2.0 wt% of Mo, 0.05 to 0.5 wt% of V, 0.002 to 0.1 wt% of Al, 0.0002 to 0.0030 wt% of B, 0.045 to 0.15 wt% of Ti not greater than 0.2 wt% in total of at least one selected from the group consisting of not greater than 0.1 wt% of Ca, not greater than 0.2 wt% of Zr, not greater than 0.2 wt% of Nb, not greater than 0.1 wt% of Mg and not greater than 0.2 wt% of W, and the balance substantially Fe and inevitable impurities, wherein the ratio Ti/Al between the Al content and the Ti content is from 0.8 to 14 and the sum of $\overline{X}$ and $\overline{Al}$ as obtained from the following formulae is not greater than 2920:

$$\overline{X}=10P+5Sb+4Sn+As$$

$$\overline{Al}=xAl$$

(x being a coefficient obtained from FIG. 4)

where P, Sb, Sn and As represent the contents of P, Sb, Sn and As contained as said inevitable impurities in terms of ppm, while Al represents the Al content in terms of ppm.

16. A heat resisting steel exhibiting a 600° C., $10^5$-hour creep rupture strength higher than 8 Kg/mm$^2$ and having a composition consisting essentially of 0.05 to 0.2 wt% of C, 0.5 to 2.5 wt% of Cr, 0.5 to 2.0 wt% of Mo, 0.05 to 0.5 wt% of V, not greater than 1 wt% of Si, not greater than 2 wt% of Mn, not greater than 0.5 wt% of Ni, 0.002 to 0.1 wt% of Al, 0.045 to 0.15 wt% of Ti, 0.0003 to 0.0030 wt% of B, not greater than 0.2 wt% in total of at least one member selected from the group consisting of not greater than 0.1 wt% of Ca, not greater than 0.2 wt% of Zr, not greater than 0.2 wt% of Nb, not greater than 0.1 wt% of Mg and not greater than 0.2 wt% of W, and the balance substantially Fe and inevitable impurities, wherein the ratio Ti/Al between the Al content and the Ti content is from 0.8 to 14 and the sum of $\overline{X}$ and $\overline{Al}$ as obtained from the following formulae is not greater than 2920:

$\overline{X}=10P+5Sb+4Sn+As$ $\overline{Al}=xAl$ (x being a coefficient obtained from FIG. 4)

where P, Sn, Sn and As represent the contents of P, Sb, Sn and As contained as said inevitable impurities in terms of ppm, while Al represents the Al content in terms of ppm.

17. A heat resisting steel exhibiting a 600° C., $10^5$-hour creep rupture strength higher than 8 Kg/mm$^2$ and having a composition consisting essentially of 0.05 to 0.2 wt% of C, 0.5 to 2.0 wt% of Cr, 0.5 to 2.0 wt% of Mo, 0.05 to 0.5 wt% of V, not greater than 1 wt% of Si, 0.002 to 0.1 wt% of Al, 0.045 to 0.15 wt% of Ti and the balance substantially Fe and inevitable impurities, wherein the ratio Ti/Al between the Al content and the Ti content is from 0.8 to 14 and the sum of X and Al as obtained from the following formulae is not greater than 2920, and the sum of $\overline{X}$ and $\overline{Si}$ as obtained from the following formulae is not greater than 3200:

$\overline{X}=10P+5Sb+4Sn+As$ $\overline{Al}=xAl$ (x being a coefficient obtained from FIG. 4)

$\overline{Si}=Si/y$ (y being a coefficient obtained from FIG. 17)

where P, Sb, Sn and As represent the contents of P, Sb, Sn and As contained as said inevitable impurities in terms of ppm, while Al and Si represent the Al and Si contents in terms of ppm.

18. A heat resisting steel according to claim 17, wherein the Al content ranges between 0.002 and 0.015 wt%. and said steel is a cast steel.

19. A heat resisting steel according to claim 17, having a composition consitsting essentially of 0.08 to 0.15 wt% of C, 0.9 to 1.7 wt% of Cr, 0.8 to 1.3 wt% of Mo, 0.1 to 0.35 wt% of V, 0.005 to 0.015 wt% of Al, not greater than 0.15 wt% of Si and the balance substantially Fe.

20. A heat resisting steel exhibiting a 600° C., $10^5$-hour creep rupture strength higher than 8 Kg/mm$^2$ and having a composition consisting essentially of 0.05 to 0.2 wt% of C, 0.5 to 2.0 wt% of Cr, 0.5 to 2.0 wt% of Mo, 0.05 to 0.5 wt% of V, not greater than 1 wt% of Si, not greater than 2 wt% of Mn, not greater than 0.5 wt% of Ni, 0.002 to 0.1 wt% of Al 0.045 to 0.15 wt% of Ti, and the balance substantially Fe and inevitable impurities, wherein the ratio Ti/Al between the Al content and the Ti content is from 0.8 to 14 and the sum of $\overline{X}$ and Al as obtained from the following formulae is not greater than 2920, and the sum of $\overline{X}$ and $\overline{Si}$ as obtained from the following formulae is not greater than 3200;

$\overline{X}=10P+5Sb+4Sn+As$ $\overline{Al}=xAl$ (x being a coefficient obtained from FIG. 4)

$\overline{Si}=Si/y$ (y being a coefficient obtained from FIG. 17)

where P, Sb, Sn and As represent the contents of P, Sb, Sn and As contained as said inevitable impurities in terms of ppm, while Al and Si represent the Al and Si contents in terms of ppm.

21. A heat resisting steel according to claim 20, having a composition consisting essentially of 0.08 to 0.15 wt% of C, 0.9 to 1.7 wt% of Cr, 0.8 to 1.3 wt% of Mo, 0.1 to 0.35 wt% of V, not greater than 0.15 wt% of Si, 0.2 to 0.6 wt% of Mn, 0.1 to 0.3 wt% of Ni, 0.005 to 0.02 wt% of Al, 0.045 to 0.15 wt% of Ti and the balance substantially Fe.

22. A heat resisting steel exhibiting a 600° C., $10^5$-hour creep rupture strength higher than 8 Kg/mm$^2$ and having a composition consisting essentially of 0.05 to 0.2 wt% of C, 0.5 to 2.0 wt% of Cr, 0.5 to 2.0 wt% of Mo, 0.05 to 0.5 wt% of V, not greater than 1 wt% of Si, 0.002 to 0.1 wt% of Al, 0.045 to 0.15 wt% of Ti, not greater than 0.2 in total of at least one member selected from the group consisting of not greater than 0.1 wt% of Ca, not greater than 0.2 wt% of Zr, not greater than 0.2 wt% of Nb, not greater than 0.1 wt% of Mg and not greater than 0.2 wt% of W, and the balance substantially Fe and inevitable impurities, wherein the ratio Ti/Al between the Al content and the Ti content is from 0.8 to 14 and the sum of $\overline{X}$ and $\overline{Al}$ as obtained from the following formulae is not greater than 2920, and the sum of $\overline{X}$ and $\overline{Si}$ as obtained from the following formulae is not greater than 3200:

$\overline{X}=10P+5Sb+4Sn+As$ $\overline{Al}=xAl$ (x being a coefficient obtained from FIG. 4)

$\overline{Si}=Si/y$ (y being a coefficient obtained from FIG. 17)

where P, Sb, Sn and As represent the contents of P, Sb, Sn and As contained as said inevitable impurities in terms of ppm, while Al and Si represents the Al and Si contents in terms of ppm.

23. A heat resisting steel having a composition consisting essentially of 0.05 to 0.2 wt% of C, 0 to 1 wt% of Si, 0 to 2 wt% of Mn, 0.5 to 2.0 wt% of Cr, 0.5 to 2.0 wt% of Mo, 0.05 to 0.5 wt% of V, 0 to 1 wt% of Ni, 0.045 to 0.15 wt% of Ti, 0.002 to 0.1 wt% of Al, 0.0003 to 0.0030 wt% of B, and the balance substantially Fe, the ratio Ti/Al between the Al content and the Ti content is from 0.8 to 14 and said steel having a 600° C. $10^5$-hour creep rupture strength of not smaller than 9 Kg/mm$^2$, a tensile elongation at room temperature of not smaller than 15% and a tensile reduction in area at room temperature of not smaller than 50%.

24. A heat resisting steel according to claim 23, having a composition consisting essentially of 0.08 to 0.15 wt% of C, 0.15 to 0.75 wt% of Si, 0.2 to 0.6 wt% of Mn, 0.9 to 1.7 wt% of Cr, 0.8 to 1.3 wt% of Mo, 0.1 to 0.35 wt% of V, 0.1 to 0.3 wt% of Ni, 0.045 to 0.15 wt% of Ti, 0.005 to 0.07 wt% of Al, 0.0005 to 0.0020 wt% of B, and the balance sustantially Fe.

25. A heat resisting steel having a composition consisting essentially of 0.05 to 0.2 wt% of C, 0 to 1 wt% of Si, 0 to 2 wt% of Mn, 0.5 to 2.0 wt% of Cr, 0.5 to 2.0 wt% of Mo, 0.05 to 0.5 wt% of V, 0 to 1 wt% of Ni, 0.045 to 0.15 wt% of Ti, 0.002 to 0.1 wt% of Al, 0.0003 to 0.0030 wt% of B, not greater than 0.2 wt% in total of at least one member selected from the group consisting of not greater than 0.1 wt% of Ca, not greater than 0.2 wt% of Zr, not greater than 0.2 wt% of Nb, not greater than 0.2 wt% of Mg and not greater than 0.2 wt% of W, and the balance substantially Fe, the ratio Ti/Al between the Al content and the Ti content is from 0.8 to 14 and said steel having a 600° C. $10^5$-hour creep rupture strength of not smaller than 9 $Kg/mm^2$, a tensile elongation at room temperature of not smaller than 15% and a tensile reduction in area at room temperature of not smaller than 50%.

* * * * *